US011986146B2

(12) United States Patent
Yu

(10) Patent No.: US 11,986,146 B2
(45) Date of Patent: May 21, 2024

(54) HANDHELD VACUUM CLEANER

(71) Applicant: DREAME TECHNOLOGY (TIANJIN) CO., LTD., Tianjin (CN)

(72) Inventor: Hao Yu, Tianjin (CN)

(73) Assignee: DREAME TECHNOLOGY (TIANJIN) CO., LTD., Tianjin (CN)

( * ) Notice: Subject to any disclaimer, the term of this patent is extended or adjusted under 35 U.S.C. 154(b) by 794 days.

(21) Appl. No.: 17/040,313

(22) PCT Filed: Apr. 30, 2019

(86) PCT No.: PCT/CN2019/085175
§ 371 (c)(1),
(2) Date: Sep. 22, 2020

(87) PCT Pub. No.: WO2019/210849
PCT Pub. Date: Nov. 7, 2019

(65) Prior Publication Data

US 2021/0085147 A1 Mar. 25, 2021

(30) Foreign Application Priority Data

May 2, 2018 (CN) ..... 201810409924.5
May 2, 2018 (CN) ..... 201810409930.0
(Continued)

(51) Int. Cl.
*A47L 9/28* (2006.01)
*A47L 5/24* (2006.01)
(Continued)

(52) U.S. Cl.
CPC ..... *A47L 9/2889* (2013.01); *A47L 5/24* (2013.01); *A47L 9/102* (2013.01); *A47L 9/1463* (2013.01);
(Continued)

(58) Field of Classification Search
CPC .... A47L 9/1691; A47L 9/2857; A47L 9/1658; A47L 9/2884; A47L 5/24
(Continued)

(56) References Cited

U.S. PATENT DOCUMENTS 8,640,301 B1 * 2/2014 Lee ..... A47L 9/106 15/327.2
11,224,324 B2 * 1/2022 Conrad ..... A47L 9/1608
(Continued)

FOREIGN PATENT DOCUMENTS

CN 103417161 A 12/2013
CN 103494583 A 1/2014
(Continued)

OTHER PUBLICATIONS

GB-2546541-A Espacenet original patent (Year: 2017).*
(Continued)

*Primary Examiner* — Brian D Keller
*Assistant Examiner* — Tim Brady
(74) *Attorney, Agent, or Firm* — Suiter Swantz IP

(57) ABSTRACT

A handheld vacuum cleaner is provided, comprising: a dust-air separating unit, an airflow generating unit, a battery pack assembly, and a handle; the dust-air separating unit is provided with a dust suction port that defines a longitudinal axis extending along a front-rear direction; the airflow generating unit is provided with an air inlet side and an air outlet side, and the air inlet side communicates with the dust-air separating unit; an outer wall of the handheld vacuum cleaner is provided with an air outlet penetrating therethrough, the air outlet port and the air outlet side are connected by an air outlet channel, and the air outlet port is arranged at least partially exceeding forward beyond the airflow generating unit in the dust-air suction direction located along the longitudinal axis. When using the vacuum
(Continued)

cleaner, the service life of the motor is lengthened and the user experience is better.

17 Claims, 16 Drawing Sheets

(30) Foreign Application Priority Data

May 2, 2018 (CN) ..... 201810410579.7
May 2, 2018 (CN) ..... 201820644756.3

(51) Int. Cl.
*A47L 9/10* (2006.01)
*A47L 9/14* (2006.01)
*A47L 9/16* (2006.01)

(52) U.S. Cl.
CPC ..... *A47L 9/165* (2013.01); *A47L 9/1658* (2013.01); *A47L 9/2884* (2013.01)

(58) Field of Classification Search
USPC ..... 15/344, 352
See application file for complete search history.

(56) References Cited

U.S. PATENT DOCUMENTS

| | | | | |
|---|---|---|---|---|
| 2004/0074042 | A1 | 4/2004 | Overvaag | |
| 2007/0056136 | A1 | 3/2007 | Stephens et al. | |
| 2014/0137364 | A1* | 5/2014 | Stickney | A47L 5/24 15/347 |
| 2017/0196421 | A1 | 7/2017 | Brown et al. | |
| 2017/0215663 | A1* | 8/2017 | Conrad | A47L 9/1625 |
| 2018/0055323 | A1* | 3/2018 | Hwang | A47L 9/2884 |
| 2019/0174984 | A1* | 6/2019 | Machida | A47L 5/14 |
| 2019/0200828 | A1* | 7/2019 | Hwang | A47L 9/1409 |
| 2020/0037834 | A1* | 2/2020 | Li | A47L 9/322 |

FOREIGN PATENT DOCUMENTS

| | | | | |
|---|---|---|---|---|
| CN | 103829879 | A | 6/2014 | |
| CN | 203861141 | U | 10/2014 | |
| CN | 204746643 | U | 11/2015 | |
| CN | 205514361 | U | 8/2016 | |
| CN | 105962846 | A | 9/2016 | |
| CN | 206063055 | U | 4/2017 | |
| CN | 106889940 | A | 6/2017 | |
| CN | 106998973 | A | 8/2017 | |
| CN | 206390854 | U | 8/2017 | |
| CN | 107280580 | A | 10/2017 | |
| CN | 206543157 | U | 10/2017 | |
| CN | 206576819 | U | 10/2017 | |
| CN | 107343774 | A | 11/2017 | |
| CN | 206934028 | U | 1/2018 | |
| CN | 107822563 | A | 3/2018 | |
| CN | 107928544 | A | 4/2018 | |
| CN | 108523761 | A | 9/2018 | |
| CN | 108523764 | A | 9/2018 | |
| CN | 108542305 | A | 9/2018 | |
| CN | 105615772 | B | 11/2018 | |
| CN | 208640587 | U | 3/2019 | |
| CN | 106388707 | B | 4/2019 | |
| CN | 209003804 | U | 6/2019 | |
| CN | 107007210 | B | 8/2022 | |
| DE | 102015106664 | A1 | 11/2016 | |
| EP | 3238590 | A4 | 6/2018 | |
| GB | 2546541 | A * | 7/2017 | A47L 5/24 |
| JP | H04109921 | A | 4/1992 | |
| JP | 2001178661 | B | 7/2001 | |
| JP | 2001353110 | A1 | 12/2001 | |
| JP | 2005230070 | A | 9/2005 | |
| JP | 2014100571 | A | 6/2014 | |
| JP | 2018064849 | A | 4/2018 | |
| WO | 2006076363 | A3 | 12/2006 | |
| WO | 2010048305 | A3 | 7/2010 | |

OTHER PUBLICATIONS

Office Action in Japanese Application No. 2020-551324 dated Nov. 15, 2021, 14 pages (with English Translation).
Partial Supplementary Search Report in European Application No. 19796553.6 dated Mar. 15, 2022.
Chinese Office Action dated Mar. 21, 2023; Chinese Application No. 201810409924.5.
Chinese Office Action dated Mar. 22, 2023; Chinese Application No. 201810409930.0.
International Search Report dated Aug. 5, 2019 for PCT/CN2019/085175.
First Examination Report dated Aug. 20, 2021 for Australian Application No. 2019263851, 7 pages.
Office Action dated Nov. 17, 2021 for Australian Application No. 2020-551324, 16 pages (with English Translation).
Office Action dated Jul. 28, 2021 for Korean Application No. 10-2020-7027218.
Japan Notice of Reasons for Refusal; Japanese Application No. 2020-551324.

* cited by examiner

B-B'

HANDHELD VACUUM CLEANER

CROSS-REFERENCE TO RELATED APPLICATIONS

The present application is a National Stage of International Application No. PCT/CN2019/085175, filed Apr. 30, 2019, which claims priority to the following patent applications: Chinese Patent Application No. 201810409924.5, filed May 2, 2018; Chinese Patent Application No. 201810409930.0, filed May 2, 2018; Chinese Patent Application No. 201810410579.7, filed May 2, 2018, and Chinese Patent Application No. 201820644756.3, filed May 2, 2018, all of which are hereby incorporated by reference in their entirety.

TECHNICAL FIELD

Embodiments of the present disclosure relates to a vacuum cleaner and, in particular, to a handheld vacuum cleaner.

BACKGROUND

Handheld vacuum cleaners are compact in size, very convenient to carry and use, and suitable for use in relatively small space. The handheld vacuum cleaner generally includes a shell, an air flow generating unit, a filter device, a dust collecting barrel and a suction nozzle. The air flow generating unit sucks air, and the air carrying dust enters the dust collecting barrel through the suction nozzle and is then filtered through the filter device, so most of the dust is left in the dust collecting barrel, and the air is discharged into the atmosphere by the air flow generating unit after passing through the filter device.

In the existing handheld vacuum cleaner, by turning on the air flow generating unit, suction power for sucking the dust is provided, a dust suction port of the vacuum cleaner is communicated with an air inlet side of the air flow generating unit, and the air flow entering from the dust suction port passes through the air inlet side of the air flow generating unit, exits from an air outlet side of the air flow generating unit and is discharged from an air outlet port on the shell of the vacuum cleaner. However, the inventor found that, during use of the vacuum cleaner, the air flow generating unit is always powered on, and the air flow generating unit will dissipate heat, while the air outlet port of the existing vacuum cleaner is provided on a side of the air outlet side of the air flow generating unit, and the air flow is discharged directly from the air outlet port of the vacuum cleaner after being discharged from the air outlet side of the air flow generating unit, then the heat dissipated by the air flow generating unit is kept in the shell and cannot be discharged immediately, such that when the vacuum cleaner is in use, the heat in the shell accumulates, and the temperature of the air flow generating unit continues to rise, which affects the service life of the air flow generating unit.

Chinese Patent No. CN208640587U discloses a handheld vacuum cleaner, including a filter device, a motor and a battery pack, the battery pack and the motor are arranged on upper and lower sides of a handle, and air flow discharged by the motor is discharged from a rear end of the handheld vacuum cleaner near a tail portion. For related structures, reference can be made to the Chinese Patent No. CN105615772B, which discloses a handheld vacuum cleaner, in which the battery pack and the motor are arranged on the upper and lower sides of the handle, but contrary to CN208640587U, air flow discharged by the motor is also discharged from a rear end of the handheld vacuum cleaner near a tail portion, so that with such arrangement, an air outlet port is closer to a user, and the air flow discharged from the motor will be blown towards the user, which affects experience of the user.

After the existing handheld vacuum cleaner is used, the filter device and the dust cup need to be cleaned. In the related art, generally, the entire filter device is pulled upwards to remove the filter device from the dust cup, and then the filter device and the dust cup are separately cleaned. The operation of pulling out the filter device is complicated and laborious, and the filter device shakes up and down, which easily disperses dust adhered on a surface into the air, causing the dust to spill out.

The handheld vacuum cleaners generally use a battery to drive the motor to rotate, and the battery is generally mounted in the handle of the handheld vacuum cleaner or between the handle and the base, and electrically connected to the motor. When the battery is working at a relatively high power, it will generate a relatively large amount of heat, and an excessively high surface temperature of the battery will cause risks, such that the power of the battery of the handheld vacuum cleaner is generally relatively low, and a low efficiency of the motor makes the cleaning effect and the cleaning efficiency unsatisfactory.

A cyclone separator of the existing handheld vacuum cleaner is arranged above a filter screen and arranged in the shell, a filter element is placed in the cyclone separator, and due to space limitations, only small filter cotton can be used for filtration, residual dust blocks the filter element after the vacuum cleaner has been used for a long time, which affects the filtering effect of the filter element, so the filter element needs to be cleaned or replaced. However, since the filter element is arranged in the cyclone separator, it is troublesome to disassemble and difficult to clean. Moreover, the cyclone separator is located above the filter screen, such that overall space of the vacuum cleaner is relatively large, the customer experience is poor, and arrangement of other components in the vacuum cleaner cannot be regulated.

SUMMARY

An object of embodiments of the present disclosure is to provide a handheld vacuum cleaner, so that the heat emitted by the motor can be discharged immediately, to reduce the temperature of the motor when the vacuum cleaner is in use and prolong the service life of the motor, and the discharged air flow will not be directly blown to the user when the vacuum cleaner is in use.

In order to solve the above technical problems, an embodiment of the present disclosure provides a handheld vacuum cleaner, including: a dust-air separating unit, an air flow generating unit, a battery pack assembly, and a handle, wherein the dust-air separating unit is provided with a dust suction port that defines a longitudinal axis (X) extending in a front-rear direction, the air flow generating unit is provided with an air inlet side and an air outlet side, the air inlet side is in communication with the dust-air separating unit, an outer wall of the handheld vacuum cleaner is provided with an air outlet port penetrating therethrough, the air outlet port is in communication with the air outlet side of the dust-air separating unit, and the air outlet port is arranged at least partially exceeding forward beyond the air flow generating unit in a dust-air suction direction along the longitudinal axis (X), the air flow discharged by the motor flows forward to exceed the air inlet side and is then discharged to the outside.

A handheld vacuum cleaner of the present disclosure, including: a dust-air separating unit, an air flow generating unit, a battery pack assembly, and a handle arranged between the air flow generating unit and the battery pack assembly, wherein the dust-air separating unit is provided with a dust suction port that defines a longitudinal axis (X) extending in a front-rear direction, an axis of the handle and the longitudinal axis (X) of the dust suction port intersect to form a certain angle, the air flow generating unit and the dust-air separating unit are communicated through an air inlet duct, an outer wall of the handheld vacuum cleaner is provided with an air outlet port for the air flow generating unit to discharge an air flow outward, the air outlet port is provided penetrating through an outer wall of an outer periphery of the air inlet duct, and a projection of the axis of the handle passes through the air outlet port.

An embodiment of the present disclosure further provides another handheld vacuum cleaner, including: a dust-air separating unit and an air flow generating unit, the dust-air separating unit is provided with a dust suction port that defines a longitudinal axis (X) extending in a front-rear direction, the air flow generating unit includes an air inlet side and an air outlet side arranged along the front-rear direction defined by the longitudinal axis (X) of the dust suction port, the air inlet side is closer to the dust-air separating unit than the air outlet side, the handheld vacuum cleaner is provided with an air outlet port communicated with the air outlet side, and the air outlet ort is arranged at least partially closer to the dust-air separating unit than the air inlet side.

Compared with the related art, for the embodiments of the present disclosure, since the dust air enters the dust-air separating unit from the dust suction port, the separated air enters from the air inlet side of the air flow generating unit and is discharged from the air outlet side of the air flow generating unit, the outer wall of the handheld vacuum cleaner is provided with the air outlet port penetrating therethrough, and the air outlet port is arranged at least partially beyond the air inlet side of the motor in front of the dust-air suction direction of the longitudinal axis X of the dust-air suction port. Therefore, when the air flow flows out from the air outlet port, it will pass through an outer periphery of the air flow generating unit, to take away the heat generated by the air flow generating unit, reducing the temperature of the motor and extending the service life of the motor. Moreover, the air flow is not discharged from the rear end of the handheld vacuum cleaner near the tail portion, and the air flow is away from the user when being discharged, which improves experience of the user.

In addition, the air flow generating unit and the dust-air separating unit are connected by an air inlet duct, and the air outlet port is at least partially located on an outer periphery of the air inlet duct.

In addition, the air outlet side of the air flow generating unit and the air outlet port are connected by an air outlet channel.

In addition, the handheld vacuum cleaner is provided with a shell wrapping around an outer periphery of the air flow generating unit, the air outlet channel is formed by a gap between the shell and the air flow generating unit, and the air flow is discharged from the air outlet side of the air flow generating unit passing through the air outlet channel and is finally discharged from the air outlet port.

In addition, the air flow generating unit is arranged longitudinally along the longitudinal axis (X) of a dust-air suction port, and the air inlet side is located in front of the air outlet side.

In addition, the shell is provided as a part of an outer profile of the handheld vacuum cleaner.

In addition, the air outlet channel includes a first air channel and a second air channel, the first air channel is located at a rear end of the air flow generating unit, the second air channel is located at the outer periphery of the air flow generating unit, the second air channel extends after turning from the first air channel in a direction towards the air inlet side of the air flow generating unit, the air outlet side of the air flow generating unit discharges the air flow backward to the first air channel, and the air flow flows from the first air channel to the second air channel and is finally discharged from the air outlet port. Thus, a circuitous section will be formed between the first air channel 1 and the second air channel, when the air flow is discharged out from the air outlet side, it can pass through the first air channel first, and is then discharged from the air outlet port after passing through the second air channel, and when the air flow is in a process of turning from the first air channel to the second air channel, the air flow will collide and buffer in the circuitous section formed between the first air channel and the second air channel. Therefore, energy when the air flow is discharged from the air outlet port is reduced, thereby reducing noise generated by the vacuum cleaner during operation, so as to improve use experiences of the user.

In addition, a deflector is further included, the deflector is in communication with the air outlet channel and tapered at downstream of the air flow, wherein the deflector is arranged around the air inlet duct.

An object of the embodiments of the present disclosure is to provide a handheld vacuum cleaner, and the handheld vacuum cleaner is more convenient to disassemble during cleaning, and it is not easy for the dust to spill out during disassembly.

In order to achieve the above object, the embodiments of the present disclosure provide a handheld vacuum cleaner, including a vacuum cleaner shell, a power device provided in the vacuum cleaner shell and a dust cup, wherein the vacuum cleaner shell includes a main shell and a mounting shell; the main shell is configured to receive the power device, the mounting shell is connected to the main shell, a mating portion is provided on a barrel wall of the dust cup, and the mating portion is configured for a buckle-connection with the mounting shell; the handheld vacuum cleaner further includes: a button and a linkage assembly located in the dust cup, the linkage assembly is configured to link triggering of the button and releasing of the buckle-connection between the mating portion and the mounting shell, and a direction in which the mating portion is buckled with the mounting shell is perpendicular to an axis center of the dust cup.

Compared with the related art, for the embodiments of the present disclosure, the handheld vacuum cleaner can release the buckle-connection between the mating portion and the mounting shell by pressing the button, so that the dust cup can be separated from the vacuum cleaner shell, and the dust cup can be removed in the horizontal direction for cleaning. The removal means is labor-saving, and the filter device will not be displaced, and it is not easy to spill dust during the removal.

In addition, the mating portion includes: a mating frame body provided on the barrel wall of the dust cup and a buckling member located in the mating frame body, and the buckling member includes a main rod and a buckle group connected to the main rod; and a through slot is provided on a side surface of the mating frame body, the mounting shell covers the side surface of the mating frame body provided with the through slot, the mounting shell is provided with a buckling block, and the buckle group penetrates through the through slot and is buckled with the buckling block.

In addition, the main rod is arranged along a length direction of the mating frame body, the through slot is provided on two side surfaces of the mating frame body in a width direction, and the buckle group includes a retracting rod connected to the main rod and a buckle connected to the retracting rod; a part of the buckle passes through the through slot and is located outside the mating frame body, and the buckling block is buckled with the part of the buckle located outside the mating frame body; and the main rod is configured to be pulled by the linkage assembly, and the retracting rod is configured to displace with the main rod and pull the buckle until the buckle is completely located in the mating frame body. When the linkage assembly is triggered, the retracting rod can pull the buckle to release the mating with the mounting shell.

In addition, two protrusions are provided on a side surface of the mating frame body, an inserting channel is formed between the two protrusions, the mounting shell is provided with an inserting member corresponding to the inserting channel, and the inserting channel and the inserting member are configured to fix the mating frame body and the mounting shell. The mating frame body and the mounting shell are mated by insert-connection, to fix the dust cup in a direction different from the buckle-connection.

In addition, the dust cup is provided with an upper opening, and the vacuum cleaner shell further includes a connecting shell, the connecting shell is connected to the main shell, the connecting shell is provided with a connecting port, and the connecting port fits with the upper opening of the dust cup; the handheld vacuum cleaner further includes: a filter device, the filter device includes a first filtering portion and a second filtering portion; a first mounting portion is provided in the dust cup, and the first filtering portion is mounted in the dust cup through the first mounting portion; a second mounting portion is provided in the connecting shell, the second filtering portion is mounted in the connecting shell through the second mounting portion, and the first filtering portion abuts against the second filtering portion. The dust cup is removed horizontally, and the part of the filter device placed in the dust cup can also be removed.

In addition, the first mounting portion is ring-shaped and located between the first filtering portion and the dust cup and includes an inner ring mounting portion and an outer ring mounting portion, and the inner ring mounting portion and the outer ring mounting portion mate with each other; and the inner ring mounting portion is buckled to and mating with the first filtering portion, and the outer ring mounting portion is buckled to and mating with an inner wall of the dust cup. The first filtering portion mounted in the dust cup can also be disassembled, and the user can clean the first filtering portion.

In addition, the linkage assembly is provided on the second mounting portion, the button includes a pressing portion and a triggering portion; and the linkage assembly includes a first connecting member, a transmission member and a second connecting member that are connected in sequence, the first connecting member is connected to the triggering portion, and the second connecting member is connected with the main rod of the buckling member.

In addition, the handheld vacuum cleaner further includes a suction nozzle arranged on the dust cup, the button is located on the suction nozzle, and the triggering portion and the first connecting member are both located in the suction nozzle. The nozzle is easy to hold, and the button is located on the nozzle, making it more convenient to press.

In addition, the transmission member is a transmission wire, and the first connecting member is configured to pull one end of the transmission wire under driving of the triggering portion; and the second connecting member is configured to pull the main rod under driving of the transmission wire.

In addition, a lifting handle is provided on the first filtering portion, and the lifting handle is configured to pull the inner ring mounting portion to separate from the outer ring mounting portion. The provision of the lifting handle makes it easier to disassemble the first filtering portion.

The purpose of the present disclosure is to provide a handheld vacuum cleaner that can dissipate heat from a heat-generating power source, so that a power source having a relatively high power can maintain a safe temperature during operation, and the handheld vacuum cleaner can use a power source having a relatively high power, so as to obtain better cleaning effects and cleaning efficiency.

In order to solve the above technical problems, the present disclosure provides a handheld vacuum cleaner, including a power source, a switch, a motor, and an air inlet duct connected to an air inlet side of the motor, wherein the power source is attached to an outer wall of the air inlet duct, and the power source, the switch and the motor are electrically connected with each other.

Compared with the related art, for the embodiments of the present disclosure, the power source is located on the outer wall of the air inlet duct of the motor, when the handheld vacuum cleaner is working, the power source supplies power and generates heat, there is air flow passing through in the air inlet duct, the air flow in the duct exchanges heat with the power source attached to the outer wall of the duct, the air flow carries the heat and is discharged, and the continuous air flow in the air inlet duct can continue to dissipate heat for the power source, such that the handheld vacuum cleaner can choose a power source having a relatively high power and ensure a safe temperature during work, thereby obtaining better cleaning effects and cleaning efficiency.

In addition, the power source is a plurality of batteries, a cross-section of the air inlet duct is circular, and the plurality of the batteries are annularly distributed on the outer wall of the air inlet duct. Being annularly distributed on the outer wall of the air inlet duct can make the heat dissipation of the battery more uniform, and the heat dissipation effect is better.

In addition, the outer wall of the air inlet duct is provided with a first fixing member and a second fixing member for installing the plurality of the batteries, the first fixing member and the second fixing member are respectively located at two ends of the plurality of the batteries in a length direction and are arranged opposite to each other, and the plurality of the batteries are mounted between the first fixing member and the second fixing member and connected in series. The first fixing member and the second fixing member mount the battery on the outer wall of the air inlet duct, and the series connection of the plurality of the batteries further increases the power of the power source, and improves the cleaning effect and cleaning efficiency of the handheld vacuum cleaner.

In addition, the handheld vacuum cleaner further includes a shell for receiving the motor, a handle connected to the shell, and a base connected to the handle, and the switch is mounted in the handle.

In addition, the handle and the base are both hollow. The hollow configuration can reduce an overall weight of the handheld vacuum cleaner and move a gravity center of the handheld vacuum cleaner up, which is more convenient for the user to operate.

In addition, bottom of the base is provided with an air outlet port, and the air outlet port is configured to discharge air coming from an air outlet side of the motor. The air discharged from the air outlet side of the motor is continuously discharged into the air through the shell, the handle and the base, and the air collides and buffers in the shell, the handle and the base, so that the energy when the air flow is discharged from the air outlet port is reduced, and the noise when the handheld vacuum cleaner is working is reduced, so as to improve the user experience.

The purpose of the embodiments of the present disclosure is to provide a handheld vacuum cleaner that makes the filter element of the vacuum cleaner easy to disassemble, is easier to clean, maintains a dust filtering power of the vacuum cleaner, and reduces a size of the vacuum cleaner.

In order to solve the above technical problems, an embodiment of the present disclosure provides a handheld vacuum cleaner, including:

- a shell for detachably connecting with a dust collecting cup of the vacuum cleaner;
- a filter screen arranged in the dust collecting cup in a surrounding manner and used for filtering dust;
- a cyclone separator arranged in the dust collecting cup and configured to be surrounded by the filter screen;
- wherein, in the shell, a receiving cavity is also for placing a filter element, and the receiving cavity is configured to be located above the cyclone separator after the shell and the dust collecting cup are detachably connected.

Compared with the related art, for the embodiments of the present disclosure, since the shell is detachably connected to the dust collecting cup, the filter screen is arranged in the dust collecting cup, the cyclone separator is arranged in the dust collecting cup, there is a receiving cavity in the shell, and the filter element is arranged in the receiving cavity and located above the cyclone separator, such that after the shell is separated from the dust collecting cup, the cyclone separator is in the dust collecting cup, and the filter element is located in the shell, then the filter element can be cleaned directly, making it convenient for cleaning. Therefore, during long-term use, the vacuum cleaner has a better dust filtering effect, and it will not be blocked by dust which may affect the use. In addition, the cyclone separator is arranged in the dust collecting cup and surrounded by the filter screen, so that the cyclone separator does not occupy other space of the vacuum cleaner, reducing the size of the vacuum cleaner and improving the customer experience. In addition, the size of the vacuum cleaner is relatively small, which makes arrangement of components inside the vacuum cleaner more regular, and internal arrangement of the vacuum cleaner is more regular. In addition, the filter element is placed in the shell, and a filter element having a larger size can be placed, so as to improve the dust filtering capacity of the vacuum cleaner.

In addition, the handheld vacuum cleaner further includes: a fixing frame for fixing the filter screen;

a bracket for fixing the fixing frame is provided in the dust collecting cup. The filter screen is fixed by the fixing frame, and the bracket fixes the fixing frame, so that the filter screen is fixed in the dust collecting cup.

In addition, the bracket is ring-shaped and includes: an outer ring portion fixedly connected to the dust collecting cup, an inner ring portion arranged opposite to the outer ring portion, and a main body portion connecting the outer ring portion and the inner ring portion, and the inner ring portion is configured to fix the fixing frame.

In addition, the main body portion extends obliquely toward bottom of the dust collecting cup in a direction from the outer ring portion to the inner ring portion; and the fixing frame includes: a fixing portion for fixing the filter screen, and a bearing portion connected to the fixing portion and surrounded by the inner ring portion, the bearing portion extends obliquely in a direction away from the fixing portion, an inclination direction of the bearing portion is consistent with an inclination direction of the main body portion, and the bearing portion further abuts against the inner ring portion. Since the main body portion and the bearing portion are both arranged obliquely, and the inclination directions are consistent, the bearing portion also abuts against the inner ring portion, so that the main body portion supports and fixes the bearing portion, and thus the fixing frame is fixed in the dust collecting cup.

In addition, the cyclone separator includes: a cyclone separator body for forming an air flow into a cyclone air flow, and a sidewall configured to surround and support the separator body and fixed to the cyclone separator body; and the cyclone separator body is provided with an air inlet port for allowing the air flow to enter into the cyclone separator body;

the handheld vacuum cleaner further includes: a supporting plate connected to the fixing frame and configured to support the sidewall. Thus, the cyclone separator is supported in the dust collecting cup by the supporting plate.

In addition, the handheld vacuum cleaner further includes: a positioning plate group for positioning the cyclone separator body, and the positioning plate group is fixedly connected with the fixing frame. Thus, the cyclone separator is positioned in the dust collecting cup through the positioning plate group.

In addition, the positioning plate group includes:

a cover plate covering at top of the cyclone separator body and abutting against the fixing frame; and a positioning plate fixed to the fixing frame; the positioning plate is provided with a plurality of positioning tubes penetrating through the cover plate and inserted into the cyclone separator body; and each of the positioning tubes is configured to discharge the cyclone air flow formed by the cyclone separator body to the receiving cavity. Since the positioning plate is fixed to the fixing frame, the positioning tube on the positioning plate penetrates the cover plate and is inserted into the cyclone separator, thereby positioning and fixing the cyclone separator in the dust collecting cup.

In addition, the handheld vacuum cleaner further includes: a fixing rod arranged on the shell and configured for fixing the filter element, and the fixed rod is inserted into the filter element. Thus, the filter element is fixed in the shell by the fixing rod.

In addition, the handheld vacuum cleaner further includes: a fixing hood arranged in the receiving cavity and configured for covering the filter element, and a abutting post connected to the shell and configured for abutting the fixing hood;

wherein a fixing rod for fixing the filter element is provided in the fixing hood, and the fixed rod is inserted into the filter element. Thus, the filter element is fixed in the shell.

In addition, the filter element is Hypa. The Hypa has a better filtering effect on the dust in the air flow, and it can be cleaned and reused without replacement.

BRIEF DESCRIPTION OF DRAWINGS

One or more embodiments are exemplified by figures in the corresponding drawings, and the exemplified descriptions do not constitute limitations on the embodiments. Elements in the drawings with the same reference numerals are denoted as similar elements, and unless otherwise specified, the drawings in the drawings do not constitute scale limitations.

DESCRIPTION OF EMBODIMENTS

In order to make the objectives, technical solutions, and advantages of the embodiments of the present disclosure clearer, the various embodiments of the present disclosure will be described in detail below with reference to the accompanying drawings. However, a person of ordinary skill in the art can understand that, in each embodiment of the present disclosure, many technical details are proposed for the reader to better understand the present disclosure. However, even without these technical details and various changes and modifications based on the following embodiments, the technical solution claimed in the present disclosure can be realized.

Figure 1:
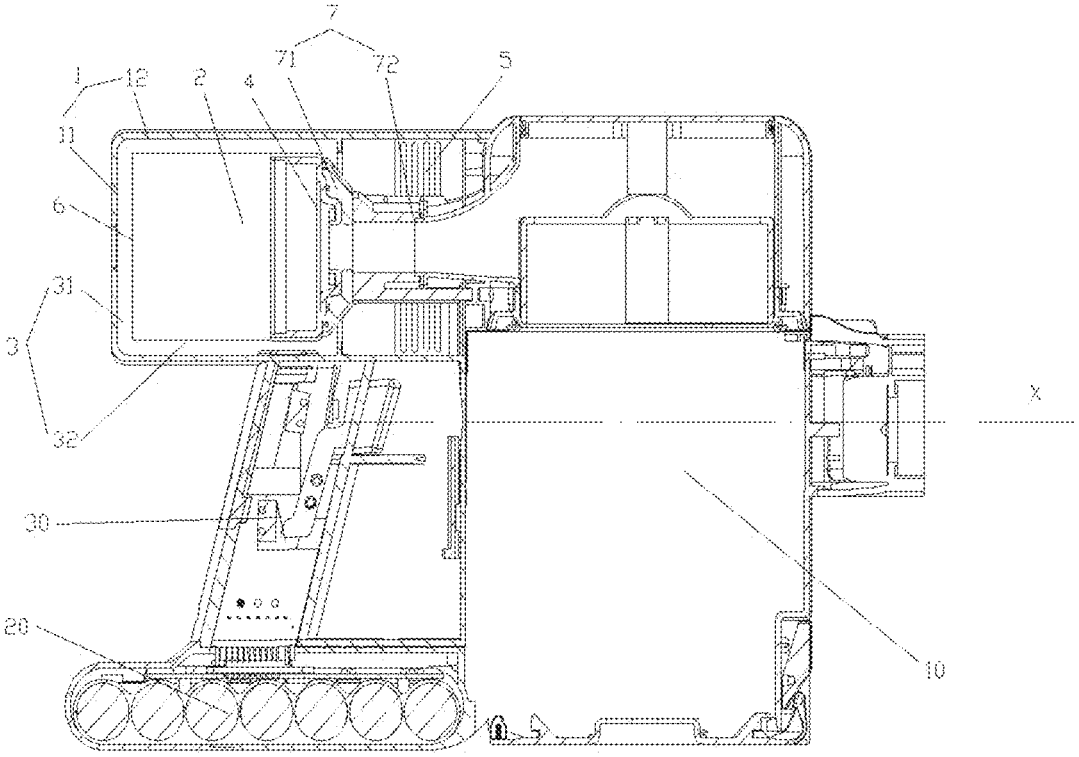
FIG. 1 is a structural schematic view of a handheld vacuum cleaner in a first embodiment of the present disclosure.

As shown in FIG. 1, the present disclosure is a handheld vacuum cleaner, including: an air flow generating unit, a dust-air separating unit 10, a battery pack assembly 20, and a handle 30 for holding and supporting the handheld vacuum cleaner by a user. The battery pack assembly 20 is configured to supply power to the air flow generating unit, to generate negative pressure air flow. The dust-air separating unit 10 is provided with a dust-air suction port. Dust-air is sucked into the dust-air separating unit 10 through the dust-air suction port, and after the dust-air is separated by the dust-air separating unit 10, an air flow is discharged by the air flow generating unit. The dust-air suction port has a longitudinal axis X. In the present disclosure, a direction in which the air flow sucks dust from the dust-air suction port is defined as front, and the air flow generating unit is configured as a motor 2.

As shown in FIG. 1, the motor 2 is provided with an air inlet side 4 and an air outlet side 6. The dust-air of the handheld vacuum cleaner enters the dust-air separating unit 10 from the dust suction port, and separated air enters from the air inlet side 4 of the motor 2 and is discharged from the air outlet side 6 of the motor 2. An outer wall of the handheld vacuum cleaner is provided with an air outlet port 5 that penetrates therethrough and is configured to discharge the air flow flowing out from the air outlet side 6 of the motor 2 to the outside. The air outlet port 5 is arranged on the outer wall between the dust-air separating unit 10 and the air flow generating unit. Moreover, the air outlet port 5 is arranged at least partially beyond the air inlet side 4 of the motor 2 in front of a dust-air suction direction of the longitudinal axis X of the dust-air suction port, and the air outlet port 5 can be located on the same straight line with the longitudinal axis X, or the air outlet port 5 can be located above or below the longitudinal axis X. The air outlet side 6 of a motor can be configured in different forms in which the motor discharges air backwards or circumferentially, which can be selected according to different implementation requirements.

As shown in FIG. 1, the handheld vacuum cleaner is provided, at the dust-air separating unit 10 and the air inlet side of the motor 2, with an air inlet duct communicating therethrough, and is provided, on the air outlet side 6, with an air outlet channel 3 communicating with the air outlet port 5. The air outlet channel 3 may be a duct, or it may be formed by using a gap between a shell and the motor 2 in a case where the shell covers the motor 2. The air inlet duct can also be a duct, or it may be formed by using a gap between a shell and the motor 2 in a case where the shell covers the motor 2.

The present disclosure will be described in detail in a form where a shell forms an air channel. The handheld vacuum cleaner includes a shell 1 arranged outside the motor and forming the air outlet channel with the motor, the motor is arranged in the shell 1, the air outlet channel 3 for the air flow to pass through is formed between the shell 1 and the motor, and the air outlet side 6 is in communication with the air outlet channel 3. The air outlet channel 3 is in communication with the air outlet port 5, and the air flow generated by the motor 2 during operation is discharged into the air outlet channel 3 from the air outlet side 6 and discharged out from the air outlet port 5 through the air outlet channel 3.

From the above content, it is not difficult to find that, since the channel 3 is provided in the shell 1, the air outlet side 6 of the motor 2 is communicated with the channel 3, and the handheld vacuum cleaner is provided with the air outlet port 5 communicating with the air outlet channel 3, when the motor 2 is in operation, the air flow enters from the air inlet side 4 and then is discharged out from the air outlet side 6, and the air flow discharged from the air outlet side 6 then enters the air outlet channel 3 and is finally discharged from the air outlet port 5. Since the air inlet side 4 of the motor 2 is arranged in front of the air outlet side 6 along the direction of the longitudinal axis X of the dust-air suction port, and the air outlet channel 3 is arranged at an outer periphery of the motor 2, so that the air flow will take away heat generated by the motor 2 together, and the heat will not be accumulated in the air channel, thereby reducing the temperature of the motor 2 and prolonging the service life of the motor 2. In one embodiment of the shell 1, the shell 1 is configured to be mounted in the handheld vacuum cleaner after being fitted with the motor 2, or the shell 1 is directly configured as a part of an external profile of the handheld vacuum cleaner, so that the structure can be simplified and materials can be saved.

Specifically, as shown in FIG. 1, the shell 1 includes a sidewall 11 disposed opposite to the air outlet side 6 of the motor 2, and a shell wall 12 connected to the sidewall 11. The shell wall 12 surrounds four sides of the sidewall 11 and forms the air outlet channel 3 with the motor 2, and the sidewall 11 is also configured to extend in a direction towards the air inlet side 4 of the motor 2.

In this embodiment, as shown in FIG. 1, the shell 1 is provided as a part of the external profile of the handheld vacuum cleaner, the air outlet port 5 is provided on the shell wall 12 to which it belongs, and the air outlet side 6 is arranged opposite to the sidewall 11. The air outlet channel 3 includes a first air channel 31 and a second air channel 32. A side of the sidewall 11 with respect to the air outlet side 6 of the motor 2 is at least partially separated from the air outlet side 6 of the motor 2, to form the first air channel 31 for the air flow to pass through. The shell wall 12 and the motor 2 are separated from each other to form the second air channel 32 communicating with the first air channel 31. The second air channel 32 extends in a direction towards the air inlet side 4 of the motor 2, and the air inlet side 2 and the air outlet side 6 may both be air vents. When the motor 2 is working, the air flow discharged from the air outlet side 6 enters the second air channel 32 from the first air channel 31 and is discharged from the air outlet port 5 on the shell 1. Thus, a circuitous section is formed between the first air channel 31 and the second air channel 32. When the air flow is discharged from the air outlet side 6 of the motor 2, it can first pass through the first air channel 31, then pass through the second air channel 32 and then be discharged from the air outlet port 5. In addition, when the air flow is entering from the first air channel 31 into the second air channel 32, the air flow will collide and buffer in the circuitous section formed between the first air channel 31 and the second air channel 32, so energy when the air flow is discharged from the air outlet port 5 is reduced, thereby reducing noise generated by the vacuum cleaner during operation, so as to improve using experiences of users.

In addition, as shown in FIG. 1, the handheld vacuum cleaner further includes a supporting frame 7, and the supporting frame 7 is arranged in the shell 1, for fixing the motor 2. The supporting frame 7 is configured to separate the air outlet side 6 of the motor 2 and the sidewall 11 from each other to form the first air channel 31. Therefore, the air flow flows to the second air channel 32 through the first air channel 31, takes away heat from the outer periphery of the motor 2 together and is discharged from the air outlet port 5, and the air flow in the first air channel 31 turns and enters into the second air channel 32, so that the air flow is discharged from the air outlet port 5 to the outside of the vacuum cleaner after being gradually weakened.

Further, as shown in FIG. 1, in order to fix the motor 2 in the shell 1, the supporting frame 7 includes a head-side frame body 71 and a tail-side frame body 72, the head-side frame body 71 is arranged on the air inlet side 4 of the motor 2, the tail-side frame body 72 is arranged on the air outlet side 6 of the motor 2, and the head-side frame body 71 and the tail-side frame body 72 are configured for mating with each other to fix the motor 2. In this embodiment, the second air channel 32 surrounds the motor 2, the air outlet port 5 can be arranged away from the motor 2 along a direction from the air outlet side 6 to the air inlet side 4 of the motor 2, and the air flow is discharged from the air outlet port 5 after flowing through the second air channel 32. Thereby, after the air flow comes out from the air outlet side 6 of the motor 2, it can buffer in the first air channel 31 and the second air channel 32 of the vacuum cleaner and then discharged, so as to reduce noise, and it will also pass around the motor 2, to take away the heat dissipated by the motor 2. The head-side frame body 71 is integrally formed with an air inlet duct, so as to facilitate connection of the motor and the dust-air separating unit 10, thereby saving an assembly process.

A second embodiment of the present disclosure relates to a handheld vacuum cleaner. This embodiment is substantially the same as the first embodiment. In this embodiment, as shown in FIG. 2, the air flow discharged from the air outlet side 6 of the motor 2 directly flows into the second air channel 32, the second air channel direction extends along the outside of the motor 2 in a direction towards the dust suction port, and the second air channel 32 is communicated with the air outlet port 5, such that when the air flow discharged from the air outlet side 6 of the motor 2 passes around the motor 2, the heat generated by the motor 2 is taken away together, and the heat will not be accumulated in the air channel, which also reduces the temperature of the motor 2 and prolongs the service life of the motor 2.

Figure 2:
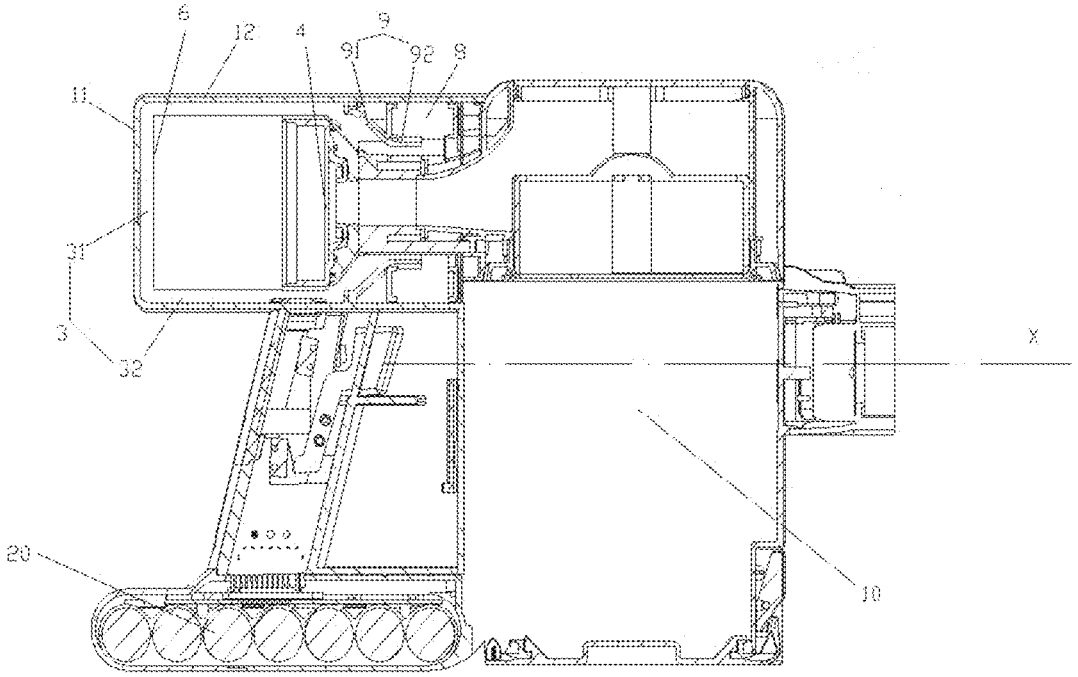
FIG. 2 is a structural schematic view of a handheld vacuum cleaner in a second embodiment of the present disclosure.

As shown in FIG. 2, the handheld vacuum cleaner according to the above two embodiments can be further provided with a filter element 8 arranged in the air outlet channel 3 and located at the air outlet port 5 so that the air flow is discharged from the air outlet port 5 after being completely filtered for a second time. The filter element 8 matches and is consistent with the shape of the inner wall of the shell 1, preferably in an annular structure, such that the air flow flowing out of the second air channel 32 is completely filtered by a filter screen and then discharged from the air outlet port 5. The handheld vacuum cleaner also includes a deflector 9 communicating with the air outlet channel 3, for collecting the flow direction of the air flow in the second air channel 32. The deflector 9 is provided with a first deflecting portion 91 matching the second air channel 32 and a second deflecting portion 92 extending and narrowing in the direction towards the dust suction port, and the second deflecting portion 92 surrounds the air inlet duct and is connected to the air inlet duct through a plurality of connecting ribs.

Further, the filter element 8 is a HyPa, and the HyPa is annularly arranged in the channel 3 of the shell. The filtering capacity of the Hypa is stronger, so that the air flow is better filtered by the Hypa.

In a preferred embodiment of the handheld vacuum cleaner, the handle 30 is arranged between the battery pack assembly 20 and the air flow generating unit, an axis of the handle 30 passes through the battery pack and the air inlet duct connecting the dust-air separating unit 10 and the air inlet side of the air flow generating unit, and in other embodiments, the battery pack assembly 20 and the air flow generating unit are located at the same end of the handle 30.

Another embodiment of the present disclosure relates to a handheld vacuum cleaner, including: a dust-air separating unit, an air flow generating unit, a battery pack assembly, and a handle arranged between the air flow generating unit and the battery pack assembly. The dust-air separating unit is provided with a dust suction port that defines a longitudinal axis extending in a front-rear direction. An axis of the handle crosses the longitudinal axis of the dust suction port to form a certain angle. The air flow generating unit and the dust-air separating unit are communicated through the air inlet duct. An outer wall of the handheld vacuum cleaner is provided with an air outlet port for the air flow generating unit to discharge the air flow to the outside, the air outlet port is arranged to penetrate through the outer wall of an outer periphery of the air inlet duct, and the projection of the axis of the handle passes through the air outlet port.

Another embodiment of the present disclosure relates to a handheld vacuum cleaner, including: a dust-air separating unit and an air flow generating unit. The dust-air separating unit is provided with a dust suction port that defines a longitudinal axis extending in a front-rear direction, and the air flow generating unit includes an air inlet side and an air outlet side arranged along the front-rear direction defined by the longitudinal axis of the dust suction port. The air inlet side is closer to the dust-air separating unit than the air outlet side. The handheld vacuum cleaner is provided with an air outlet port communicating with the air outlet side, and the air outlet port is arranged at least partially closer to the dust-air separating unit than the air inlet side.

Figure 3:
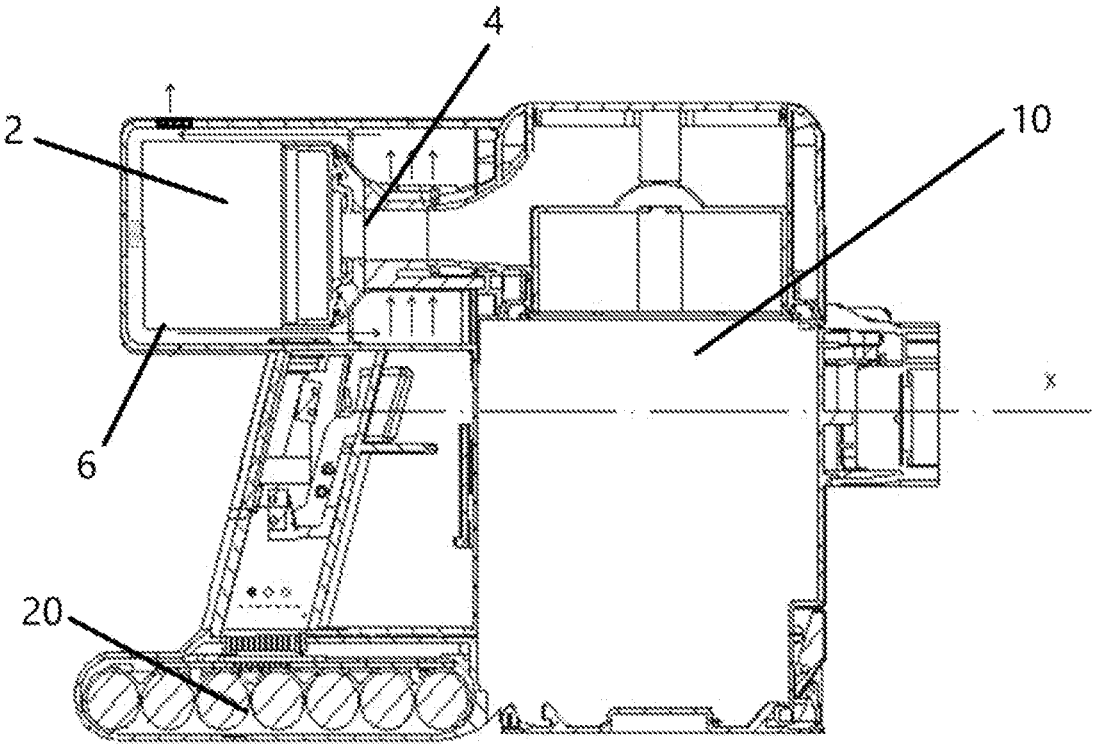
FIG. 3 is a structural schematic view of a handheld vacuum cleaner in a third embodiment of the present disclosure.

Referring to FIG. 3, a third embodiment of the present disclosure relates to a handheld vacuum cleaner, including a dust-air separating unit and an air flow generating unit. The dust-air separating unit is provided with a dust suction port that defines a longitudinal axis extending in a front-rear direction. The air flow generating unit includes an air inlet side and an air outlet side arranged along the front-rear direction defined by the longitudinal axis of the dust suction port. The exterior of the air flow generating unit is covered with a shell, and the shell separates the air flow generating unit along an axial direction to form air outlet channels on both sides of the air flow generating unit. The air outlet side of the air flow generating unit faces the air flow channel at one side, that is, the air outlet channel in the present disclosure. After the air flow discharged from the air outlet side of the air flow generating unit extends in the direction towards the air inlet side and exceeds the air inlet side, then flows to the air flow channels at the other side, and flows along the outer periphery of the air flow generator in a direction towards the air outlet side. In this way, the air outlet port can also be arranged at the rear end of the air flow generator, and it can also be achieved that the air flow discharged by the air flow generator takes away the heat of the air flow generator, and an air outlet distance is extended to reduce noise. For details, reference can be made to the schematic view of flowing of the air flow in FIG. 3.

Figure 4:
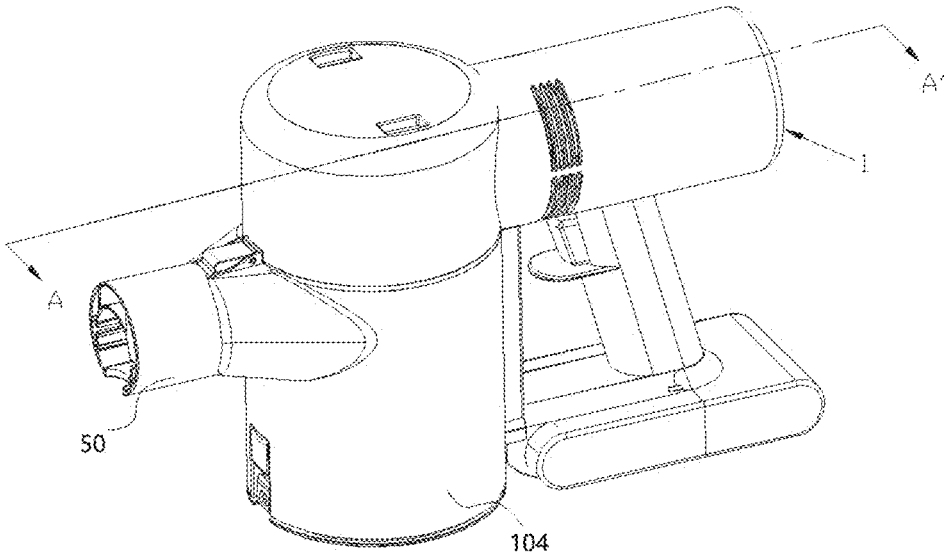
FIG. 4 is an overall schematic view of a handheld vacuum cleaner in a fourth embodiment.
Figure 5:
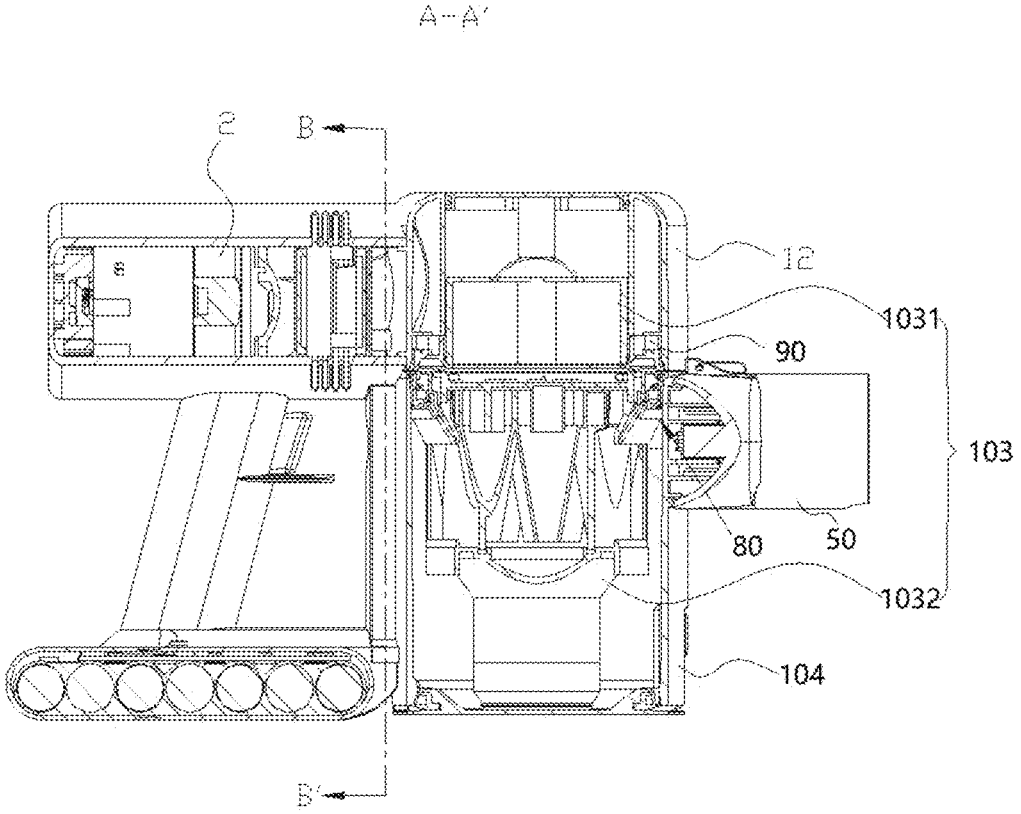
FIG. 5 is a cross-sectional view along A-A' in FIG. 4.

A fourth embodiment of the present disclosure relates to a handheld vacuum cleaner. As shown in FIGS. 4 and 5, it includes a vacuum cleaner shell 1, a power device (e.g., motor) 2, a filter device 103 and a dust collecting cup 104. The power device 2 is placed in the vacuum cleaner shell 1. The dust collecting cup 104 is provided with a suction nozzle 50, and the suction nozzle 50 is configured to absorb dust. The air carrying the dust enters the dust collecting cup 104 from the suction nozzle 50, then enters the power device 2 through the filter device 103 and is discharged through the power device 2.

Figure 6:
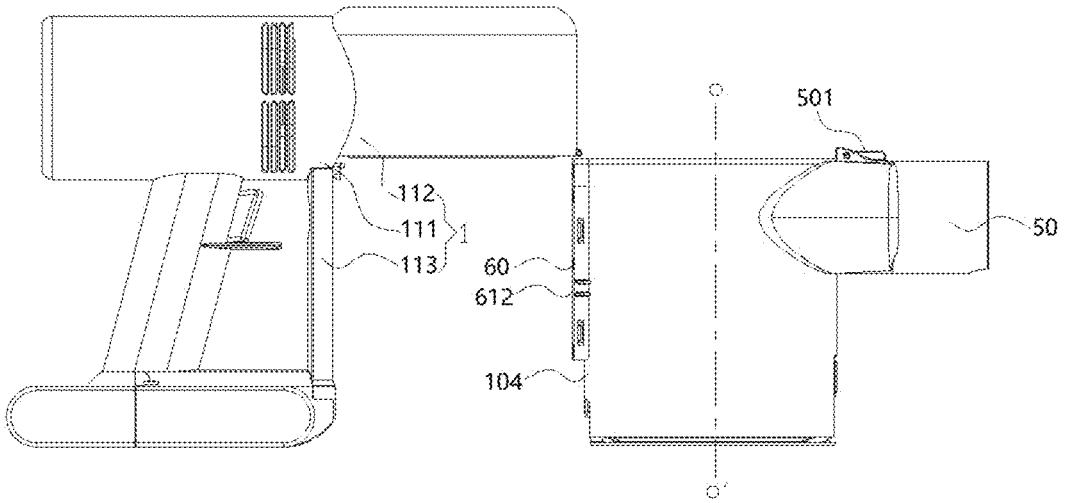
FIG. 6 is a schematic view of disassembling of a dust cup.

It is worth noting that, as shown in FIG. 6, the vacuum cleaner shell 1 in this embodiment includes a main shell 111, a connecting shell 112, and a mounting shell 113, and the main shell 111 is configured to accommodate the power device 2. The connecting shell 112 is connected on the main shell 111, and the connecting shell 112 is columnar, of which a lower opening fits with an upper opening of the dust collecting cup 104. The mounting shell 113 is connected on the main shell 111 for mounting the dust collecting cup 104, a mating portion 60 is provided on an upper sidewall of the dust collecting cup 104, and the mating portion 60 and the mounting shell 113 are buckle-connected to each other. The suction nozzle 50 is provided with a button 501. It is appreciated that, the button 501 can also be provided at other positions on the handheld vacuum cleaner. In this embodiment, only a case where the button 501 is provided on the suction nozzle 50 is taken as an example for description. A linkage assembly 70 is provided in the dust collecting cup 104, and the linkage assembly 70 is configured to link triggering of the button 501 and releasing of the buckling between the mating portion 60 and the mounting shell 113. That is, by pressing the button 501, the dust collecting cup 104 can be disassembled from the mounting shell 113, and a disassembly operation is very convenient. Moreover, a buckle-connection direction between the mating portion 60 and the mounting shell 113 is perpendicular to an axis center OO' of the dust collecting cup 104 and after the matching of the mating portion 60 and the mounting shell 113 is released, the dust collecting cup 104 can be removed horizontally in any direction facing away from the mounting shell 113.

Figure 7:
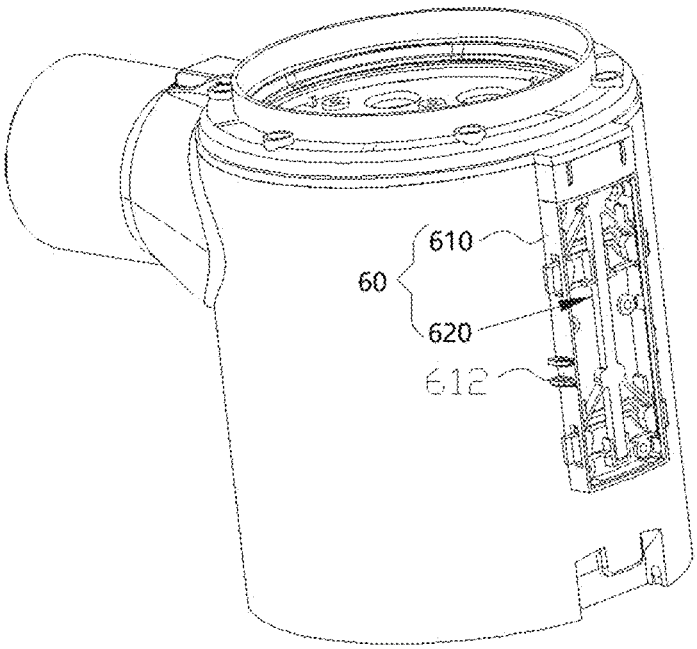
FIG. 7 is a structural schematic view of a mating portion.
Figure 8:
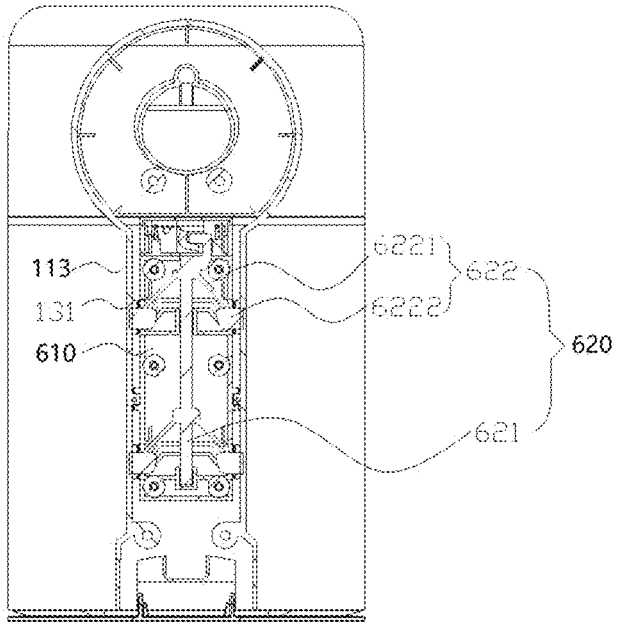
FIG. 8 is a cross-sectional view along B-B' in FIG. 5.
Figure 9:
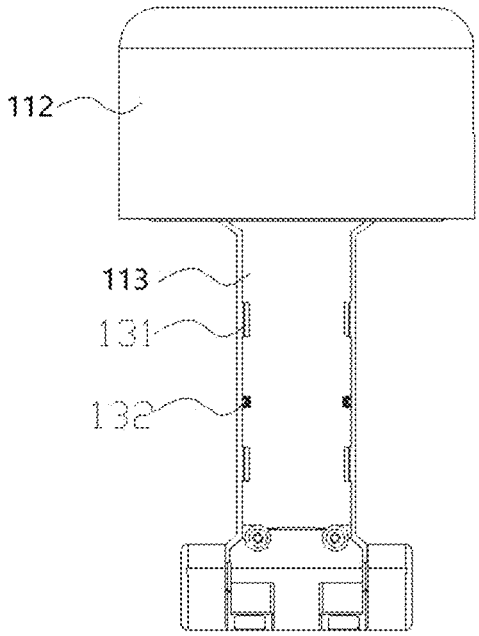
FIG. 9 is a structural schematic view of a mounting shell.

In this embodiment, as shown in FIG. 7, the mating portion 60 includes a mating frame body 610 and a buckling member 620 located in the mating frame body 610, with reference to FIG. 8, the mounting shell 113 covers the mating frame body 610, the buckling member 620 includes a main rod 621 arranged along a direction of a length of the mating frame body 610 and a buckle group 622 connected on the main rod 621, the main rod 621 is located at middle of the mating frame body 610, and the buckle group 622 includes a retracting rod 6221 connected to the main rod 621 and a buckle 6222 connected to the retracting rod 6221. The mounting shell 113 is provided with a buckling block 131 at a position corresponding to the buckle 6222. With reference to FIGS. 7 and 8, two sides of the mating frame body 610 are each provided with a through slot 611, the buckle 6222 penetrates through the through slot 611 and is buckled with the buckling block 131, and a buckle-connection direction is horizontally provided. As shown in FIG. 7, in order to prevent the dust collecting cup 104 from falling in a vertical direction, two protrusions are provided on the mating frame body 610, an inserting channel 612 along the horizontal direction is formed between the two protrusions. With reference to FIG. 9 in connection, the mounting shell 113 is provided with an inserting member 132, and the mating frame body 610 and the mounting shell 113 are mated with each other by plugging-in, to realize vertical fixation of the dust collecting cup 104. Moreover, the mating of the inserting channel 612 and the inserting member 132 also defines that a removal direction of the dust collecting cup 104 is along the insert-connection direction.

It can be seen from the above that, when removing the dust collecting cup 104, as shown in FIG. 6, the button 510 is pressed first, and the mating frame body 610 and the mounting shell 113 are released from the mating, such that a user can withdraw the dust collecting cup 104 along the insert-connection direction of the inserting member 132, to remove the dust collecting cup 104 horizontally, and dust in the barrel will not shake up and down, which may cause the dust to overflow.

It is worth noting that, as shown in FIG. 5, the filter device 103 is generally larger in size, and a part of it is placed in the dust collecting cup 104, such that when removing the dust collecting cup 104 horizontally, the filter device 103 will block the removal of the dust collecting cup 104. However, in this embodiment, the filter device 103 includes a first filtering portion 1031 and a second filtering portion 1032, the first filtering portion 1031 is mounted in the dust collecting cup 104 through a first mounting portion 80, and the second filtering portion 1032 is mounted in the connecting shell 112 through a second mounting portion 90. The first filtering portion 1031 and the second filtering portion 1032 abut each other, and the first mounting portion 80 and the second mounting portion 90 abut each other, such that when the dust collecting cup 104 is horizontally disassembled, the first filtering portion 1031 and the first mounting portion 80 are disassembled together with the dust collecting cup 104, to avoid blocking the dust collecting cup 104.

Figure 10:
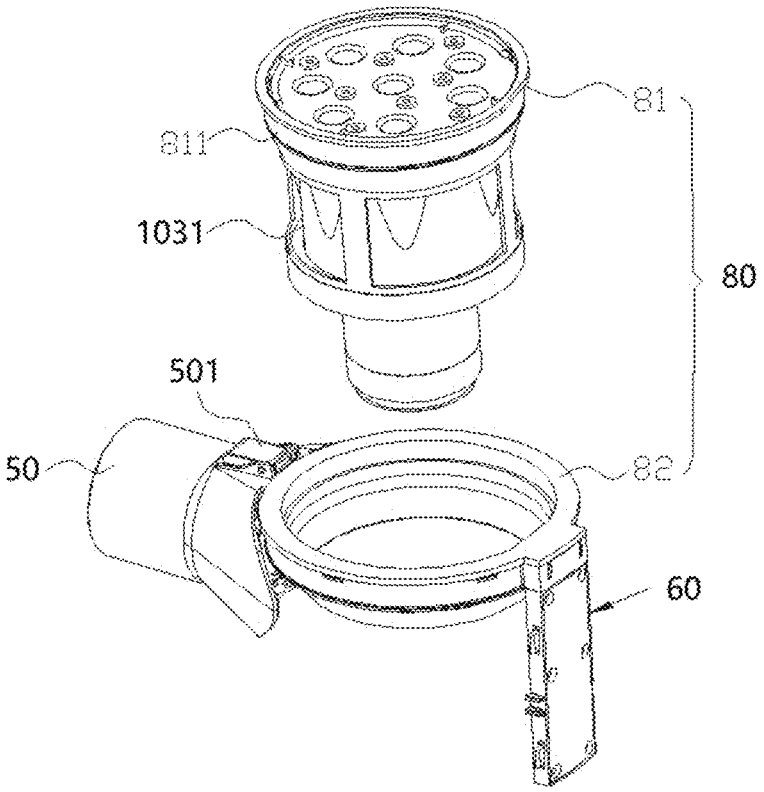
FIG. 10 is a schematic view of installation of a first filter device.

As shown in FIG. 10, the first mounting portion 80 is ring-shaped and includes an inner ring mounting portion 81 and an outer ring mounting portion 82, the outer ring mounting portion 82 is buckle-connected to and mating with the inner wall of the dust collecting cup 104, the inner ring mounting portion 81 is buckle-connected to and mating with the first filtering portion 1031, a lower end of the outer ring mounting portion 82 is in a conical shape and extends downward. Similarly, a corresponding position of the inner ring mounting portion 81 corresponding to a tapered portion 811 of the outer ring mounting portion 82 is the tapered portion 811, and the tapered portion 811 of the outer ring mounting portion 82 and the tapered portion 811 of the inner ring mounting portion 81 mate with each other, ensuring positions of the inner ring mounting portion 81 and the first filtering portion 1031 in the dust collecting cup 104. A handle is further provided on the inner ring mounting portion 81, and the handle can pull the inner ring mounting portion 81 and the first filtering portion 1031 upward together, to separate the inner ring mounting portion 81 and the outer ring mounting portion 82, to further remove the first filtering portion 1031 after removal of the dust collecting cup 104 is completed.

Figure 11:
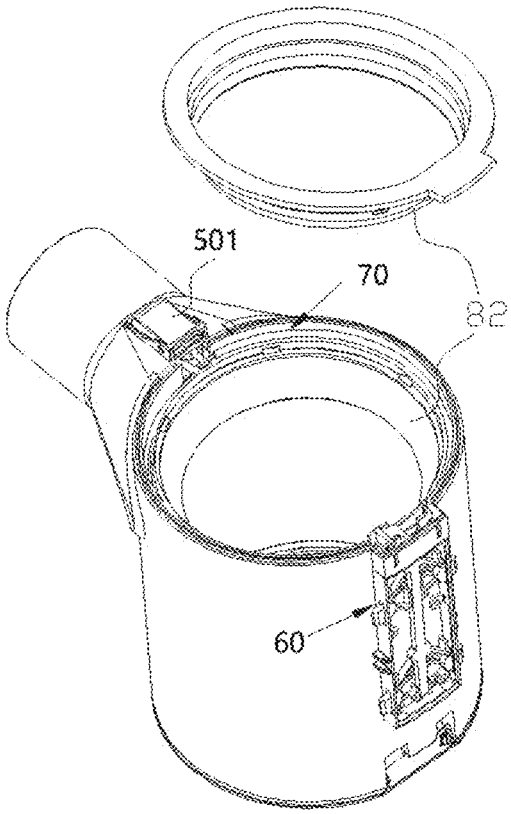
FIG. 11 is a structural schematic view of a linkage assembly and an outer ring mounting portion.
Figure 12:
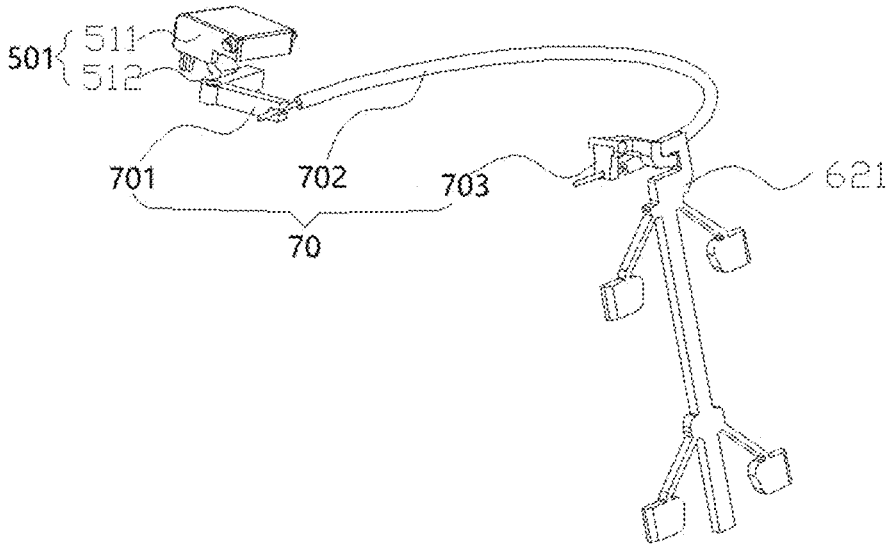
FIG. 12 is a schematic view of connection between the linkage assembly and the button, and between the linkage assembly and the main rod.

In this embodiment, as shown in FIG. 11, the linkage assembly 70 is provided in the outer ring mounting portion 82, and the linkage assembly 70 is respectively connected with the button 501 and the mating portion 60. The linkage assembly 70 is configured to link the triggering of the button 501 and the releasing of the buckle-connection between the mating portion 60 and the mounting shell 113. As shown in FIG. 12, the button 510 includes a pressing portion 511 and a triggering portion 512, the linkage assembly 70 includes a first connecting member 710, a transmission member and a second connecting member 703 connected in sequence, the first connecting member 701 is connected to the triggering portion 512, the second connecting member 703 is connected to the main rod 621 of the buckling member 620. In this embodiment, the transmission member is a transmission wire 702, and it is appreciated that, in this embodiment, only the transmission wire 702 is adopted as an example for illustration, and no specific limitation is made.

The pressing portion 511 is exposed outside the suction nozzle 50, for being pressed by a user. The triggering portion 512 is integrally provided with the pressing portion 511, to abut against the first connecting member 701, so that when the user presses the pressing portion 511, the triggering portion 512 integrally provided rotates accordingly, so as to push the first connecting member 701. The first connecting member 701 is hinged on a platform in the suction nozzle 50, and the first connecting member 701 rotates around a hinge point under pushing of the triggering portion 512, to pull one end of the transmission wire 702. With reference to FIG. 11, the transmission wire 702 is along and around the axis center of the dust collecting cup 104 and attached to a sidewall of the outer ring mounting portion 82. As shown in FIG. 12, the other end of the transmission wire 702 is connected to the main rod 621 of the buckling member 620, and the transmission wire 702 pulls the main rod 621 to rise. With reference to FIG. 8, the retracting rod 6221 rises with the main rod 621, the buckle group 622 also includes a blocking block 623 arranged in the mating frame body 610, the blocking block 623 abuts the retracting rod 6221, and the retracting rod 6221 is an elastic rod. When the retracting rod 6221 rises, it will approach the main rod 621 under an action of the blocking block 623, to drive the buckle 6222 to retract, and when the buckle 6222 completely retracts into the mating frame body 610, the mating between the buckle 6222 and the buckling block 131 is released, thereby releasing the mounting of the dust collecting cup 104 from the vacuum cleaner shell 1.

It is worth noting that, the pressing portion 511 is mounted on the suction nozzle 50 in an elastic hinging manner, so that after the pressing is completed, the button 501 can automatically rebound to a to-be-triggered state.

It can be seen from the above that, when removing the dust collecting cup 104, the pressing portion 511 of the button 501 is pressed, to trigger the triggering portion 512 of the button 501, the triggering portion 512 pulls, through the linkage assembly 70, the main rod 621 of the buckling member 620 in the mating portion 60 to move upward, the retracting rod 6221 of the buckling member 620 drives the buckle 6222 to retract into the mating frame body 610 under the action of the blocking block 623 while moving upward with the main rod 621, to release the mating between the mounting shell 113 and the mating portion 60, and the user can hold the suction nozzle 50 to pull the dust collecting cup 104 along the length direction of the inserting channel 612, that is, the horizontal direction. The first filtering portion 1031 mounted in the dust collecting cup is disassembled along with the dust collecting cup 104, and the button 501 is pressed to realize horizontally removing of the dust collecting cup, which is not only convenient for disassembly, but also avoids shaking of the filter device 103 and prevents the dust from overflowing. Moreover, the provision of the inner ring mounting portion 81 and the handle facilitates the disassembly and cleaning of the first filtering portion 1031.

Figure 13:
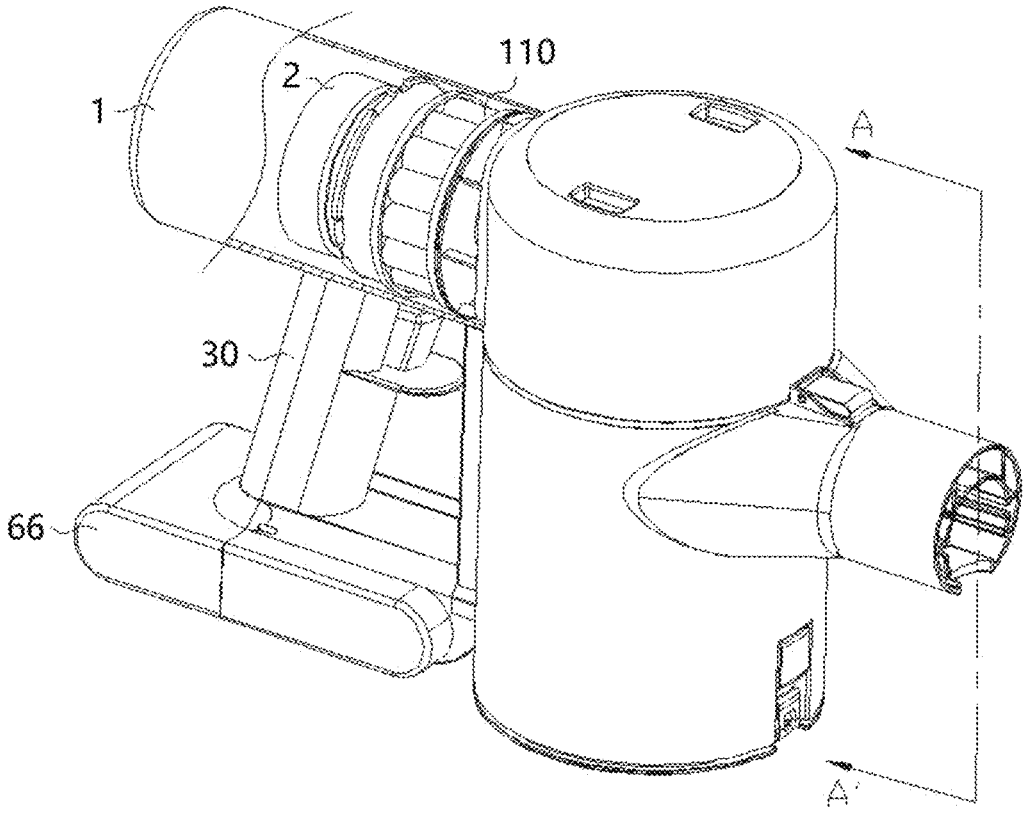
FIG. 13 is a structural schematic view assembly of a handheld vacuum cleaner in a fifth embodiment.
Figure 14:
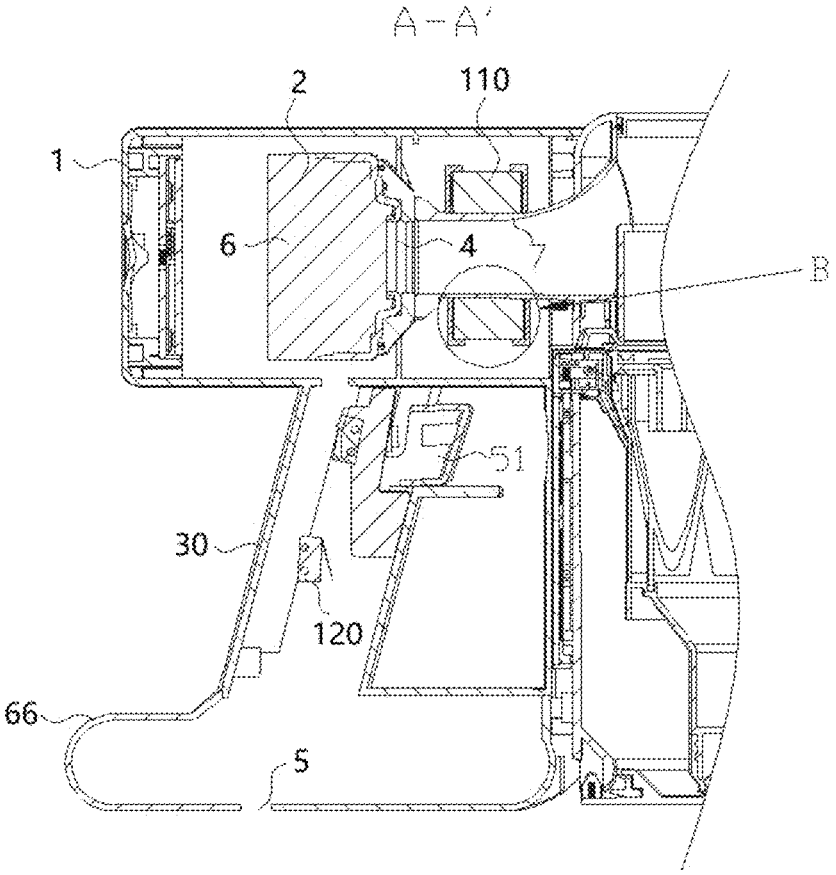
FIG. 14 is a cross-sectional view at A-A' in FIG. 13.

A fifth embodiment of the present disclosure relates to a handheld vacuum cleaner, as shown in FIG. 13, including a motor 2, a shell 1 receiving the motor 2, a handle 30 and a base 66. With reference to FIG. 14, a power source and a switch 120 are provided in the handheld vacuum cleaner. When the switch 120 is turned on, the power source supplies power to the motor 2, and the motor 2 runs to provide a suction force for the handheld vacuum cleaner.

As shown in FIG. 14, the motor 2 includes an air inlet side 4 and an air outlet side 6. The handheld vacuum cleaner also includes an air inlet duct 77. The air inlet duct 77 is connected at the air inlet side 4, that is, the air flow sucked by the handheld vacuum cleaner enters the motor 2 through the air inlet duct 77, and the air flow passes through the motor 2 and then is discharged through the air outlet side 6. In this embodiment, the power source is a plurality of batteries 110. It is appreciated that, the power source can also be other power source devices, and this embodiment does not make any special limitation thereto. A cross-section of the air inlet duct 77 is circular, and the plurality of batteries 110 are annularly distributed on an outer wall of the air inlet duct 77 and attached to the outer wall of the air inlet duct 77.

Figure 15:
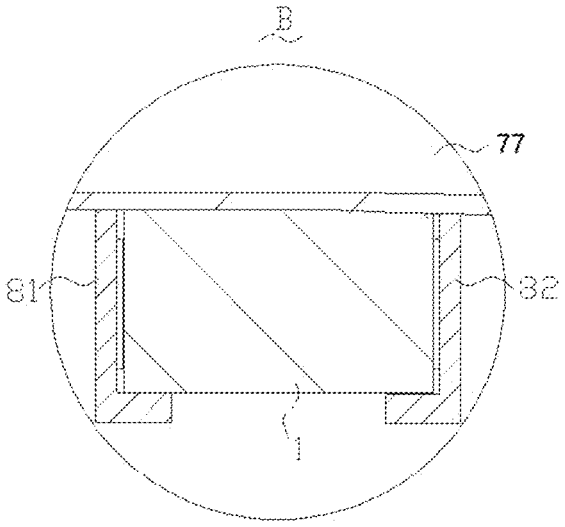
FIG. 15 is an enlarged view of B in FIG. 14.

Moreover, as shown in FIG. 15, the handle 30 is hollow, and a switch 120 is disposed in the handle 30. The switch 120, the power source and the motor 2 are connected in series to form a closed circuit. The handle 30 is provided with a button 501. A user can press the button 501 to trigger the switch 120 and turn on the closed circuit, so the power source supplies power to the motor 2, and the handheld vacuum cleaner starts to work.

It is worth noting that, when the handheld vacuum cleaner is working, the plurality of batteries 110 attached to the outer wall of the air inlet duct 77 will generate heat, which will cause the temperature of the surface of the batteries 110 to increase. At the same time, there is an air flow passing through the air inlet duct 77, and the batteries 110 attached to the outer wall of the air inlet duct 77 can exchange heat with the air flow in the air inlet duct 77, to transfer the heat to the air flow, and the air flow carrying the heat is discharged into the air through the motor 2. The air flow passing through the air inlet duct 77 can discharge part of the heat generated by the batteries 110, and the continuous air flow in the air inlet duct 77 can continue to dissipate the heat from the plurality of batteries 110, to reduce the temperature of the surface of the batteries 110. In this embodiment, the power of the batteries 110 is relatively large, and a big amount of heat is generated during operation. However, due to the heat dissipation effect of the air flow in the air inlet duct 77, the plurality of batteries 110 can keep the temperature of the surface thereof within a safe range during operation, and no danger will occur, while the batteries 110 having a relatively large power can improve the cleaning efficiency and the cleaning ability of the vacuum cleaner, and enhance use experiences of the users.

In addition, as shown in FIG. 15, the handheld vacuum cleaner also includes a first fixing member 1081 and a second fixing member 1082 arranged on the outer wall of the ventilation duct, and the first fixing member 1081 and the second fixing member 1082 are configured to install the plurality of batteries 110 on the outer wall of the ventilation duct. The first fixing member 1081 and the second fixing member 1082 are respectively located on two sides of the batteries 110 in a length direction and arranged opposite to each other, and the plurality of batteries 110 are sequentially connected in series between the first fixing member 1081 and the second fixing member 1082. Directions of positive electrodes of any two adjacent ones of the batteries 110 are opposite. The first fixing member 1081 and the second fixing member 1082 are both made of insulating materials, and both are provided with a plurality of combined guide plates. The plurality of the combined guide plates are arranged in sequence. The combined guide plate includes a positive electrode guide plate and a negative electrode guide plate that are electrically connected, for electrically connecting positive and negative electrodes of the two adjacent batteries 110, to realize the series connection of the plurality of the batteries 110. The series connection of the plurality of the batteries 110 realizes the increase of the power of the power source, which can further improve the cleaning power and the cleaning efficiency. Moreover, under the heat dissipation effect of the air flow in the air inlet duct 77, the plurality of the batteries 110 connected in series can keep the temperature of the surface thereof within a safe range during operation, and no danger will occur.

In addition, as shown in FIG. 14, the base 66 is also hollow. Hollow configurations of the handle 30 and the base 66 of the handheld vacuum cleaner reduces an overall weight of the handheld vacuum cleaner and moves up a gravity center of the handheld vacuum cleaner, making it more convenient for users to operate the handheld vacuum cleaner.

It is worth noting that, as shown in FIG. 14, bottom of the base 66 is provided with an air outlet port 5. The air discharged by the motor 2 continuously passes through the shell 1, the handle 30 and the base 66, and it is then discharged through the air outlet port 5. The air discharged from the motor 2 has a relatively high flow rate, and there will be relatively large noise when it is directly discharged into the air, while collision and buffer occur when the air passes through the shell 1, the handle 30 and the base 66, so that the speed of the air discharged from the air outlet port 15 is reduced, and the noise is relatively low, thereby further improving the use experiences of the users.

The handheld vacuum cleaner in this embodiment, by installing the power source on the outer wall of the air inlet duct, can continue to dissipate heat for the power source, such that relatively large power can be selected for the power source, to improve the cleaning efficiency and the cleaning ability of the handheld vacuum cleaner, and by providing the air outlet port 5 on the base 66, the air discharged by the motor 2 can be buffered, and the noise can be reduced when discharging the air.

Figure 16:
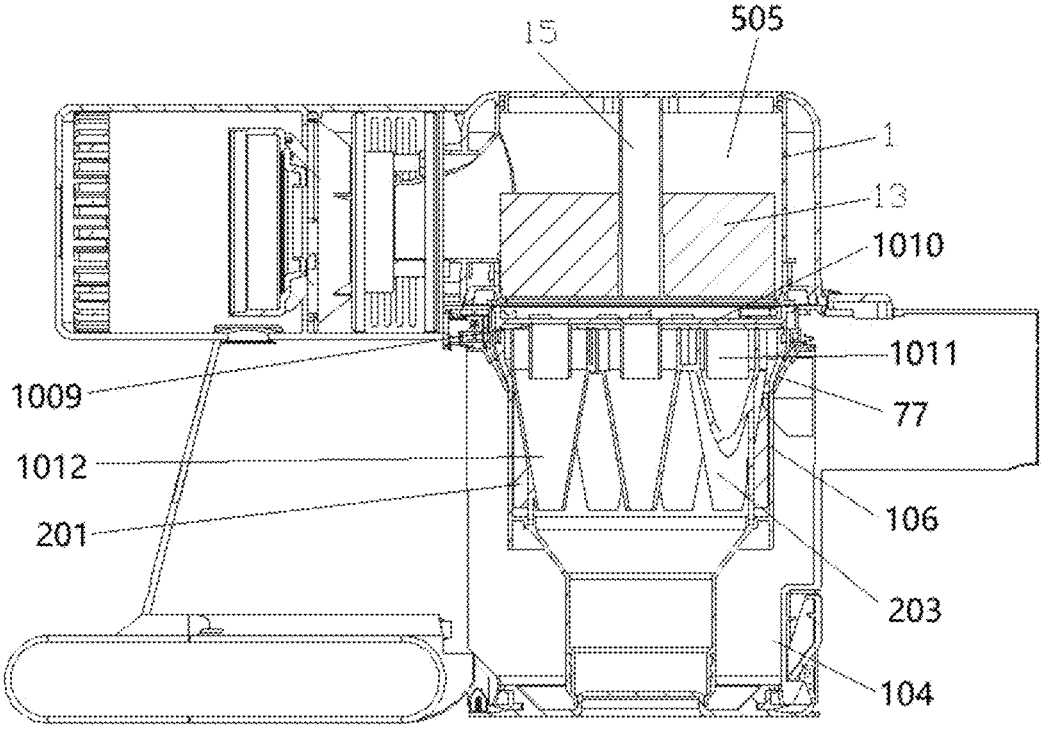
FIG. 16 is an overall structural schematic view of a handheld vacuum cleaner in a sixth embodiment of the present disclosure.

A sixth embodiment of the present disclosure relates to a handheld vacuum cleaner, as shown in FIG. 16, including a shell 1, a filter screen 201, and a cyclone separator 203. The shell 1 is configured for detachably connecting with a dust collecting cup 104 of the vacuum cleaner. The filter screen 201 is arranged in the dust collecting cup 104 in a surrounding manner, for filtering the dust. The cyclone separator 203 is arranged in the dust collecting cup 104 and configured to be surrounded by the filter screen 201. A receiving cavity 505 for placing a filter element 13 is further provided in the shell 1, and the receiving cavity 505 is configured to be located above the cyclone separator 203 after the shell 1 and the dust collecting cup 104 are detachably connected.

It is not difficult to find from the above that, since the shell 1 and the dust collecting cup 104 are detachably connected, the filter screen 201 is provided in the dust collecting cup 104, the cyclone separator 203 is provided in the dust collecting cup 104, and the shell 1 has the receiving cavity 505 therein, the filter element 13 is arranged in the receiving cavity 505 and located above the cyclone separator 203, so that after the shell 1 is separated from the dust collecting cup 104. The cyclone separator 203 is in the dust collecting cup 104, the filter element 13 is located in the shell 1, and the filter element 13 can be cleaned directly, making it convenient for cleaning. Therefore, during long-term use, the vacuum cleaner maintains a better dust filtering effect, and it will not be blocked by the dust to affect the use. In addition, the cyclone separator 203 is arranged in the dust collecting cup 104 and surrounded by the filter screen 201, so that the cyclone separator 203 does not occupy other space of the vacuum cleaner, reducing a volume of the vacuum cleaner and improving customer experiences. In addition, the volume of the vacuum cleaner is relatively small, such that arrangement of components inside the vacuum cleaner is more regular, and internal arrangement of the vacuum cleaner is more regular. In addition, the filter element 13 is placed in the shell 1, and a filter element 13 having a relatively large volume can be adopted, to improve the dust filtering capacity of the vacuum cleaner.

In addition, as shown in FIG. 16, the handheld vacuum cleaner also includes a fixing frame 106 and a bracket 107. The fixing frame 106 is configured for fixing the filter screen 201, and the bracket 107 is arranged in the dust collecting cup 104 and configured for fixing the fixing frame 106. The filter screen 201 is fixed by the fixing frame 106, and the bracket 107 fixes the fixing frame 106, so that the filter screen 201 is fixed in the dust collecting cup 104.

Figure 17:
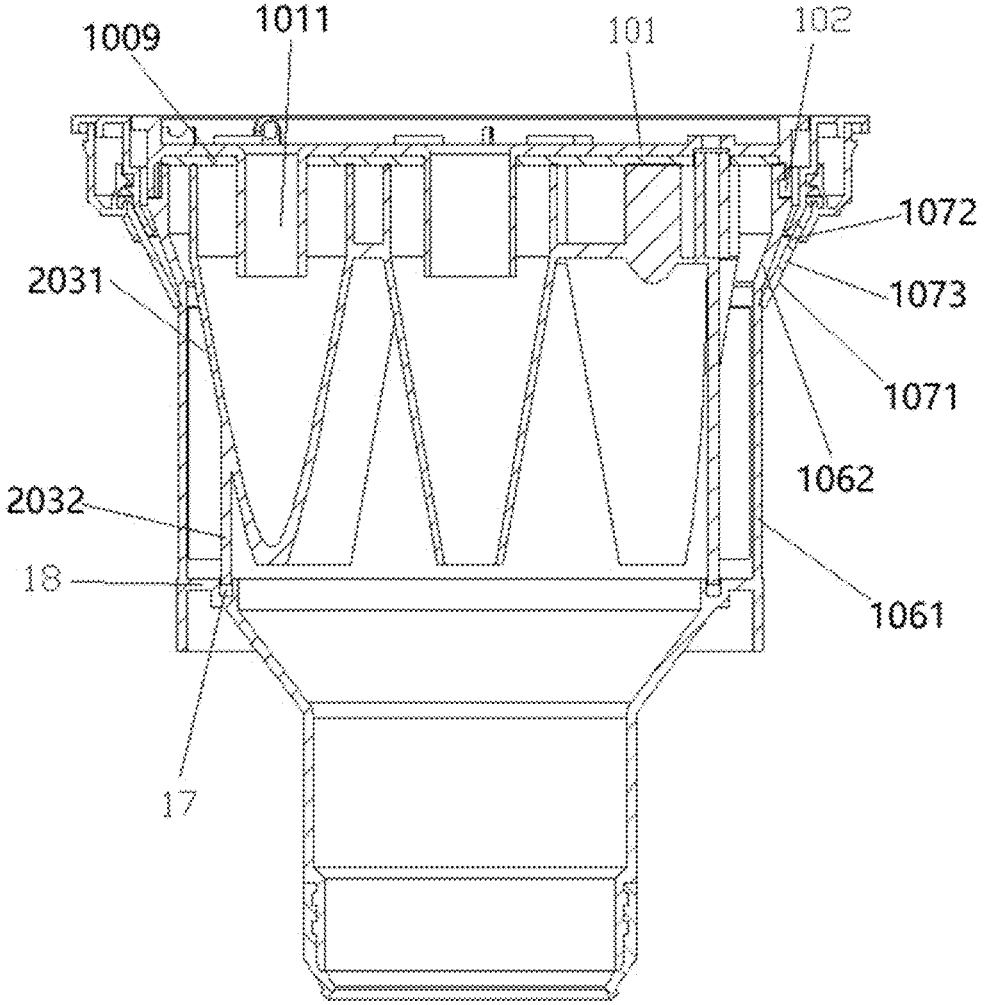
FIG. 17 is a cross-sectional view of a cyclone separator in the sixth embodiment of the present disclosure being fixed in a fixing frame.

Further, as shown in FIG. 16 and FIG. 17, the bracket 107 is ring-shaped, and it includes an outer ring portion 1071 fixedly connected to the dust collecting cup 104, an inner ring portion 1072 disposed opposite to the outer ring portion 1071, and a main body portion 1073 connecting the outer ring portion 1071 and the inner ring portion 1072, and the inner ring portion 1072 is configured to fix the fixing frame 106.

Specifically, as shown in FIG. 16 and FIG. 17, the main body portion 1073 extends obliquely toward the bottom of the dust collecting cup 104 along a direction from the outer ring portion 1071 to the inner ring portion 1072. The fixing frame 106 includes a fixing portion 1061 for fixing the filter screen 201 and a bearing portion 1062 connected to the fixing portion 1061 and surrounded by the inner ring portion 1072. The bearing portion 1062 extends obliquely in a direction away from the fixing portion 1061, and an inclination direction of the bearing portion 1062 is consistent with an inclination direction of the main body portion 1073. The bearing portion 1062 also abuts against the inner ring portion 1072. Since both the main body portion 1073 and the bearing portion 1062 are arranged obliquely and have the consistent oblique directions, and the bearing portion 1062 also abuts against the inner ring portion 1072, so that the main body portion 1073 supports and fixes the bearing portion 1062, thereby fixing the fixing frame 106 in the dust collecting cup 104.

Figure 18:
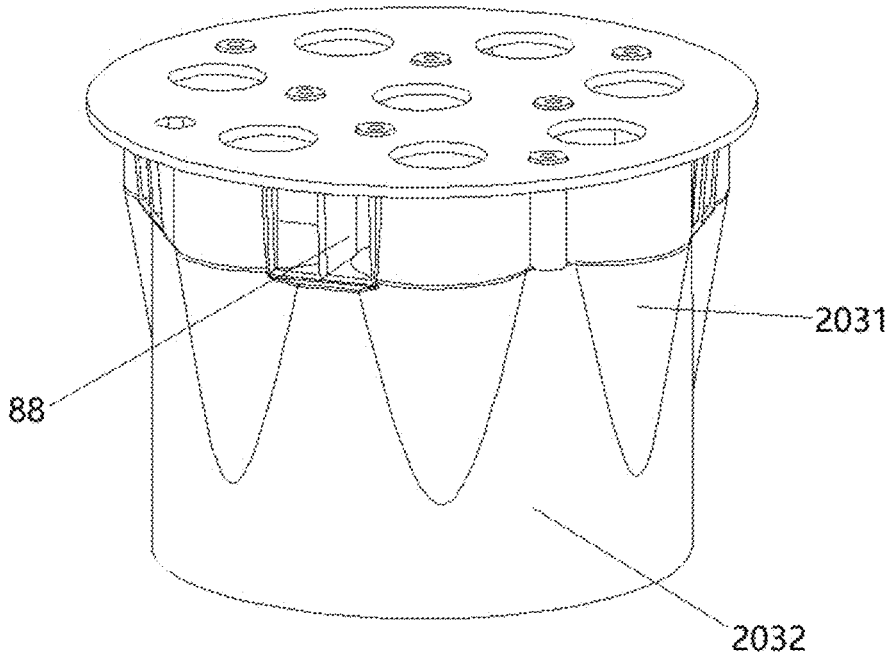
FIG. 18 is a structural schematic view of the cyclone separator in the sixth embodiment of the present disclosure.
Figure 19:
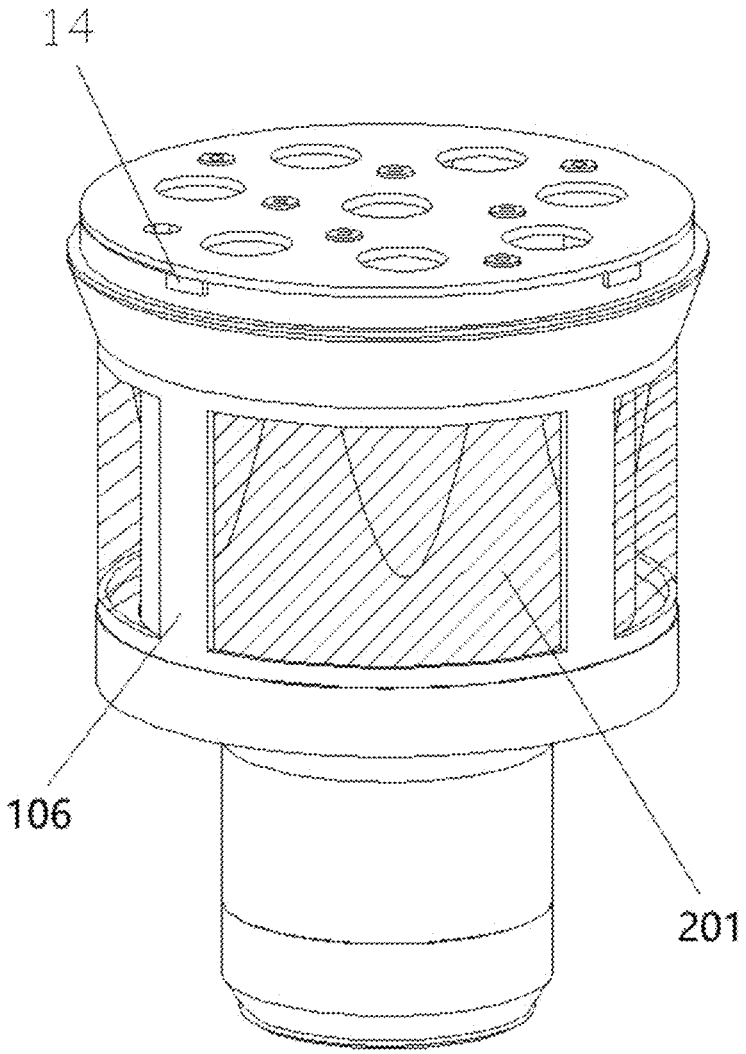
FIG. 19 is a structural schematic view of fixing of the cyclone separator and the fixing frame in the sixth embodiment of the present disclosure.

Further, as shown in FIG. 17, FIG. 18 and FIG. 19, the cyclone separator 203 includes a cyclone separator body 2031 for forming an air flow into a cyclone air flow, and a sidewall 2032 configured to support the separator body in a surrounding manner and fixed to the cyclone separator body 2031, and the cyclone separator body 2031 is provided with an air inlet port 88 for allowing the air flow to enter into the cyclone separator body 2031. The handheld vacuum cleaner also includes a supporting plate 18 connected to the fixing frame 106 and configured to support the sidewall 2032. Thus, the cyclone separator 203 is supported in the dust collecting cup 104 by the supporting plate 18. In this embodiment, in order to position the cyclone separator 203 in the dust collecting cup, the supporting plate 18 is provided with a recess 17 for inserting the sidewall 2032. Thus, to the cyclone separator 203 is positioned and fixed by inserting the sidewall 2032 into the recess 17.

It is worth mentioning that, as shown in FIG. 16 and FIG. 17, the handheld vacuum cleaner also includes a positioning plate group for positioning the cyclone separator body 2031, and the positioning plate group is fixedly connected with the fixing frame 106. The positioning plate group includes a cover plate 1009 and a positioning plate 1010. The cover plate 1009 covers at top of the cyclone separator body 2031 and abuts against the fixing frame 106. The positioning plate 1010 is fixed to the fixing frame 106, and the positioning plate 1010 is provided with a plurality of positioning tubes 1011 penetrating the cover plate 1009 and inserted into the main body of the cyclone separator 203. In addition, each of the positioning tubes 1011 is configured to discharge the cyclone air flow formed by the cyclone separator body 2031 to the receiving cavity 505. Since the positioning plate 1010 is fixed to the fixing frame 106, and the positioning tubes 1011 on the positioning plate 1010 penetrate through the cover plate 1009 and are inserted into the cyclone separator 203, so as to position and fix the cyclone separator 3 in the dust collecting cup 104.

Specifically, as shown in FIG. 18, when the handheld cyclone separator 203 is in use, the air flow suctioned by the vacuum cleaner is filtered by the filter screen 201 and then enters into the cyclone separator body 2031 from the air inlet port 88. There are a plurality of cone cavities 1012 in the cyclone separator body 2031, and the air flow is formed into the cyclone air flow in the cone cavity. Moreover, one positioning tube 1011 is inserted in each of the cone cavities, and the cyclone air flow is discharged into the filter element 13 through the positioning tube 1011.

Figure 20:
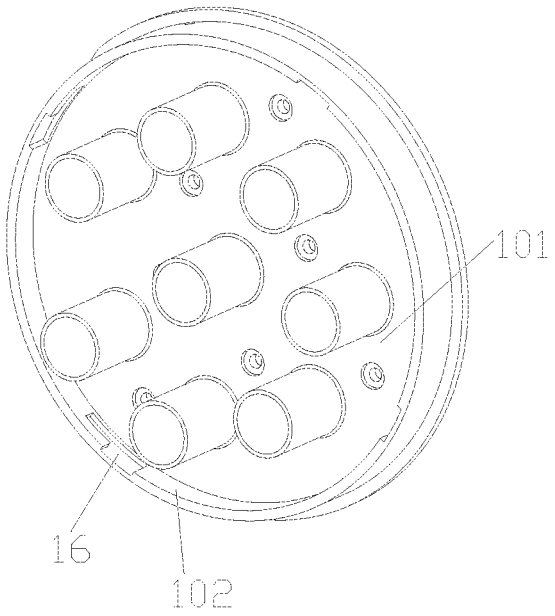
FIG. 20 is a structural schematic view of a positioning plate in the sixth embodiment of the present disclosure.

In this embodiment, as shown in FIG. 19 and FIG. 20, in order to fix the positioning plate 1010 and the fixing frame 106 and facilitate assembly and disassembly, the positioning plate 1010 and the fixing frame 106 are snap-fitted. The positioning plate 1010 is divided into two parts: a top plate 101 and a side plate 102. The positioning tube 1011 is provided on the top plate 101, the side plate 102 is provided with a recess 16, and a side surface of the fixing frame 106 is provided with a protrusion 14 inserted into the recess 16. During installation, the positioning tube 1011 penetrates through the cover plate 1009 and is inserted into the cyclone separator 203, and the protrusion 14 on the fixing frame 106 is inserted into the recess 16, such that the positioning plate 1010 is fixed to the fixing frame 106, and the cyclone separator 203 is also fixed by the positioning plate 1010.

In addition, as shown in FIG. 16, the handheld vacuum cleaner further includes a fixing rod 15 arranged on the shell 1 and used for fixing the filter element 13, and the fixing rod 15 is inserted into the filter element 13. Thus, the filter element 13 is fixed in the shell 1 by the fixing rod 15. In addition, in this embodiment, the filter element 13 may be Hypa. Hypa has a better filtering effect on the dust in the air flow, and it can be cleaned and then reused without replacement.

Figure 21:
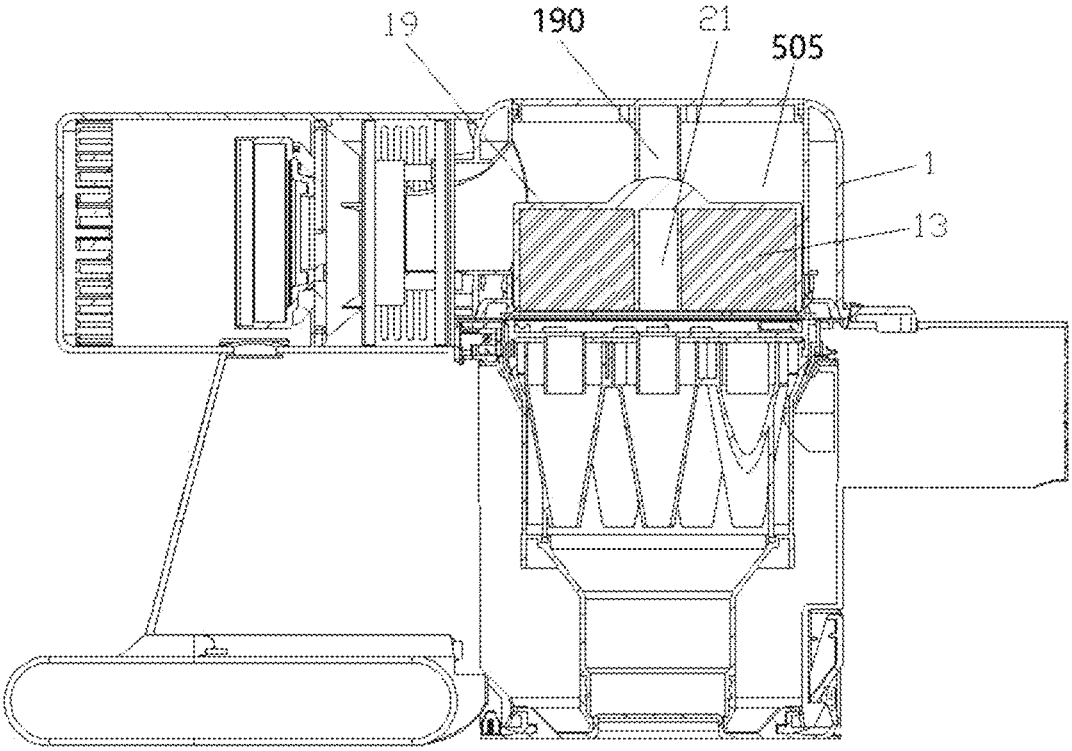
FIG. 21 is an overall structural schematic view of a handheld vacuum cleaner in a seventh embodiment of the present disclosure.

A seventh embodiment of the present disclosure relates to a handheld vacuum cleaner, and in the handheld vacuum cleaner, the fixing method of the filter element 13 in the receiving cavity 505 is different from that of the sixth embodiment. As shown in FIG. 21, the handheld vacuum cleaner includes a fixing hood 19 arranged in the receiving cavity 505 and configured for hooding the filter element 13, and a abutting post 190 connected with the shell 1 and used for abutting the fixing hood 19. A fixing rod 21 for fixing the filter element 13 is provided in the fixing hood 19, and the fixing rod 21 is inserted into the filter element 13.

Those of ordinary skill in the art can understand that the above-mentioned embodiments are specific examples for implementing the present disclosure, while in practical applications, various changes can be made in form and details without departing from the spirit and scope of the present disclosure.

The invention claimed is:

1. A handheld vacuum cleaner, comprising: a dust-air separating unit, an air flow generating unit, a battery pack assembly, and a handle, wherein the dust-air separating unit is provided with a dust suction port that defines a longitudinal axis (X) extending in a front-rear direction, the air flow generating unit is provided with an air inlet side and an air outlet side, the air inlet side is in communication with the dust-air separating unit, an outer wall of the handheld vacuum cleaner is provided with an air outlet port penetrating therethrough, the air outlet port and the air outlet side of the air flow generating unit are connected by an air outlet channel, and the air outlet port is arranged at least partially exceeding forward beyond the air flow generating unit in a dust-air suction direction along the longitudinal axis (X), wherein the air flow generating unit is arranged longitudinally along the longitudinal axis (X) of a dust-air suction port, and the air inlet side is located in front of the air outlet side; wherein the air flow generating unit and the dust-air separating unit are connected by an air inlet duct, and the air outlet port is at least partially located on the shell wall of the shell of the cleaner outside the outer periphery of the air inlet duct, and wherein the cleaner further comprises a deflector in communication with the air outlet channel and tapered at downstream of the air flow, wherein the deflector is arranged around the air inlet duct.

2. The handheld vacuum cleaner according to claim 1, wherein the handheld vacuum cleaner is provided with a shell wrapping around an outer periphery of the air flow generating unit, the air outlet channel is formed by a gap between the shell and the air flow generating unit, and the air flow is discharged from the air outlet side of the air flow generating unit passing through the air outlet channel and is finally discharged from the air outlet port; wherein the shell is provided as a part of an outer profile of the handheld vacuum cleaner.

3. The handheld vacuum cleaner according to claim 1, wherein the first air channel is located at a rear end of the air flow generating unit, the second air channel is located at the outer periphery of the air flow generating unit, the second air channel extends after turning from the first air channel in a direction towards the air inlet side of the air flow generating unit, the air outlet side of the air flow generating unit discharges the air flow backward to the first air channel, and the air flow flows from the first air channel to the second air channel and is finally discharged from the air outlet port.

4. A handheld vacuum cleaner, comprising: a dust-air separating unit and an air flow generating unit, the dust-air separating unit is provided with a dust suction port that defines a longitudinal axis (X) extending in a front-rear direction, the air flow generating unit comprises an air inlet side and an air outlet side arranged along the front-rear direction defined by the longitudinal axis (X) of the dust suction port, the air inlet side is closer to the dust-air separating unit than the air outlet side, the air outlet side is provided to discharge air at one side from a rear end circumference of a motor, and an air flow discharged from the air outlet side flows forward along an outer periphery of the motor to exceed beyond an air inlet side of the motor, wherein an axis of the handle and the longitudinal axis (X) of the dust suction port intersect to form a certain angle, the air flow generating unit and the dust-air separating unit are communicated through an air inlet duct, an outer wall of the handheld vacuum cleaner is provided with an air outlet port for the air flow generating unit to discharge an air flow outward, the air outlet port is provided penetrating through the outer wall of the handheld vacuum cleaner outside an outer periphery of the air inlet duct, and a projection of the axis of the handle passes through the air outlet port.

5. The handheld vacuum cleaner according to claim 4, wherein the air outlet port is communicating with the air outlet side, the air outlet port is at least partially arranged closer to the dust-air separating unit than the air inlet side; or the air outlet port is arranged close to the air outlet side at rear of the air flow generating unit, after the air flow discharged from the air outlet side flows forward and exceeds beyond the air inlet side of the motor, and then flows backward in a direction towards the air outlet side along an outer periphery of the air flow generating unit and is discharged.

6. A handheld vacuum cleaner, comprising a vacuum cleaner shell, a power device provided in the vacuum cleaner shell and a dust cup, wherein the vacuum cleaner shell comprises a main shell and a mounting shell;

the main shell is configured to receive the power device, the mounting shell is connected to the main shell, a mating portion is provided on a barrel wall of the dust cup, and the mating portion is configured for a buckle-connection with the mounting shell;

the handheld vacuum cleaner further comprises: a button and a linkage assembly located in the dust cup, the linkage assembly is configured to link triggering of the button and releasing of the buckle-connection between the mating portion and the mounting shell, and a direction in which the mating portion is buckled with the mounting shell is perpendicular to an axis center of the dust cup, wherein the mating portion comprises: a mating frame body provided on the barrel wall of the dust cup and a buckling member located in the mating frame body, and the buckling member comprises a main rod and a buckle group connected to the main rod.

7. The handheld vacuum cleaner according to claim 6, wherein a through slot is provided on a side surface of the mating frame body, the mounting shell covers the side surface of the mating frame body provided with the through slot, the mounting shell is provided with a buckling block, and the buckle group penetrates through the through slot and is buckled with the buckling block.

8. The handheld vacuum cleaner according to claim 7, further comprising: a power source, a switch, a motor, and an air inlet duct connected to an air inlet side of the motor, wherein the power source is attached to an outer wall of the air inlet duct, and the power source, the switch and the motor are electrically connected with each other.

9. The handheld vacuum cleaner according to claim 8, wherein the power source is a plurality of batteries, a cross-section of the air inlet duct is circular, and the plurality of the batteries are annularly distributed on the outer wall of the air inlet duct.

10. The handheld vacuum cleaner according to claim 9, wherein the outer wall of the air inlet duct is provided with a first fixing member and a second fixing member for installing the plurality of the batteries, the first fixing member and the second fixing member are respectively located at two ends of the plurality of the batteries in a length direction and are arranged opposite to each other, and the plurality of the batteries are mounted between the first fixing member and the second fixing member and connected in series.

11. The handheld vacuum cleaner according to claim 7, further comprising:

a shell for detachably connecting with a dust collecting cup of the vacuum cleaner;

a filter screen arranged in the dust collecting cup in a surrounding manner and used for filtering dust;

a cyclone separator arranged in the dust collecting cup and configured to be surrounded by the filter screen;

wherein in the shell, a receiving cavity is also provided for placing a filter element, and the receiving cavity is configured to be located above the cyclone separator after the shell and the dust collecting cup are detachably connected.

12. The handheld vacuum cleaner according to claim 11, further comprising: a fixing frame for fixing the filter screen; and a bracket for fixing the fixing frame is provided in the dust collecting cup.

13. The handheld vacuum cleaner according to claim 12, wherein the bracket is ring-shaped and comprises: an outer ring portion fixedly connected to the dust collecting cup, an inner ring portion arranged opposite to the outer ring portion, and a main body portion connecting the outer ring portion and the inner ring portion, and the inner ring portion is configured to fix the fixing frame.

14. The handheld vacuum cleaner according to claim 7, wherein the main rod is arranged along a length direction of the mating frame body, the through slot is provided on two side surfaces of the mating frame body in a width direction, and the buckle group comprises a retracting rod connected to the main rod and a buckle connected to the retracting rod;

a part of the buckle passes through the through slot and is located outside the mating frame body, and the buckling block is buckled with the part of the buckle located outside the mating frame body; and the main rod is configured to be pulled by the linkage assembly, and the retracting rod is configured to displace with the main rod and pull the buckle until the buckle is completely located in the mating frame body.

15. The handheld vacuum cleaner according to claim 14, wherein two protrusions are provided on a side surface of the mating frame body, an inserting channel is formed between the two protrusions, the mounting shell is provided with an inserting member corresponding to the inserting channel, and the inserting channel and the inserting member are configured to fix the mating frame body and the mounting shell.

16. The handheld vacuum cleaner according to claim 15, wherein the dust cup is provided with an upper opening, and the vacuum cleaner shell further comprises a connecting shell, the connecting shell is connected to the main shell, the connecting shell is provided with a connecting port, and the connecting port fits with the upper opening of the dust cup;

the handheld vacuum cleaner further comprises: a filter device, the filter device comprises a first filtering portion and a second filtering portion;

a first mounting portion is provided in the dust cup, and the first filtering portion is mounted in the dust cup through the first mounting portion; a second mounting portion is provided in the connecting shell, the second filtering portion is mounted in the connecting shell through the second mounting portion, and the first filtering portion abuts against the second filtering portion.

17. The handheld vacuum cleaner according to claim 16, wherein the first mounting portion is ring-shaped and located between the first filtering portion and the dust cup and comprises an inner ring mounting portion and an outer ring mounting portion, and the inner ring mounting portion and the outer ring mounting portion mate with each other; and the inner ring mounting portion is buckled to and mating with the first filtering portion, and the outer ring mounting portion is buckled to and mating with an inner wall of the dust cup.

* * * * *